US008011652B2

(12) United States Patent
Tsukamoto et al.

(10) Patent No.: US 8,011,652 B2
(45) Date of Patent: Sep. 6, 2011

(54) SHEET FEED DEVICE AND IMAGE FORMING APPARATUS

(75) Inventors: Kazuyuki Tsukamoto, Ebina (JP); Shin Takeuchi, Ashigarakami (JP); Minoru Ohshima, Ebina (JP); Yoshinari Iwaki, Ebina (JP); Takao Furuya, Ebina (JP); Kaoru Yoshida, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 147 days.

(21) Appl. No.: 12/207,191

(22) Filed: Sep. 9, 2008

(65) Prior Publication Data

US 2009/0236794 A1 Sep. 24, 2009

(30) Foreign Application Priority Data

Mar. 21, 2008 (JP) ..... 2008-073040
Mar. 21, 2008 (JP) ..... 2008-073394

(51) Int. Cl.
*B65H 3/14* (2006.01)

(52) U.S. Cl. ..... 271/97; 271/110; 271/114; 271/117

(58) Field of Classification Search ..... 271/97, 271/117, 114, 110
See application file for complete search history.

(56) References Cited

U.S. PATENT DOCUMENTS 6,354,585 B1 3/2002 Takahashi
2006/0170145 A1* 8/2006 Nakane ..... 271/97
2006/0175746 A1* 8/2006 Adachi ..... 271/97
2007/0080491 A1 4/2007 Suga et al.
2007/0133069 A1 6/2007 Sunada

FOREIGN PATENT DOCUMENTS

| | | |
|---|---|---|
| JP | A-7-315595 | 12/1995 |
| JP | A-10-45273 | 2/1998 |
| JP | A-2000-103535 | 4/2000 |
| JP | A-2000-344358 | 12/2000 |
| JP | A-2003-312893 | 11/2003 |
| JP | A-2005-320086 | 11/2005 |
| JP | A-2006-27842 | 2/2006 |
| JP | A-2006-27843 | 2/2006 |
| JP | A-2006-213502 | 8/2006 |
| JP | A-2006-256820 | 9/2006 |
| JP | A-2007-161427 | 6/2007 |

OTHER PUBLICATIONS

Jan. 5, 2010 Office Action issued in corresponding Japanese Patent Application No. 2008073394 (with translation).
Jul. 12, 2010 Office Action issued in Australian Patent Application No. 2008229697.

* cited by examiner

*Primary Examiner* — David H Bollinger
(74) *Attorney, Agent, or Firm* — Oliff & Berridge, PLC

(57) ABSTRACT

A sheet feed device includes an air flow generating part that generates an air flow for floating a sheet; a feed member that feeds a sheet by rotating, while applying a load to the top one of sheets stacked; and a transport condition sensing unit that is positioned not to obstruct an air flow generated by the air flow generating part and senses a transport condition of a sheet fed by the feed member.

17 Claims, 30 Drawing Sheets

IMAGE FORMING APPARATUS 10

S10

SHEET FEED DEVICE AND IMAGE FORMING APPARATUS

CROSS-REFERENCE TO RELATED APPLICATIONS

This application is based on and claims priority under 35 USC 119 from Japanese Patent Application Nos. 2008-073394 filed Mar. 21, 2008 and 2008-073040 filed Mar. 21, 2008.

BACKGROUND

Technical Field

The present invention relates to a sheet feed device and an image forming apparatus.

SUMMARY

According to an aspect of the invention, there is provided a sheet feed device including an air flow generating part that generates an air flow for floating a sheet; a feed member that feeds a sheet by rotating, while applying a load to the top one of sheets stacked; and a transport condition sensing unit that is positioned not to obstruct an air flow generated by the air flow generating part and senses a transport condition of a sheet fed by the feed member.

BRIEF DESCRIPTION OF THE DRAWINGS

Exemplary embodiments of the present invention will be described in detail based on the following figures, wherein:

FIGS. 4A to 4C are enlarged views of a feed member a sensing part, and periphery thereof, wherein FIG. 4A is an enlarged front view when the feed member applies a load to sheets, FIG. 4B is an enlarged side view when the feed member applies a load to sheets, and FIG. 4C is an enlarged side view when the feed member does not apply a load to sheets (unloaded state);

FIGS. 12A to 12C illustrate modification examples of the feed member, the sensing part, and the periphery thereof, wherein FIG. 12A is a side view illustrating a first modification example, FIG. 12B is a side view illustrating a second modification example, and FIG. 12C is a top view illustrating a third modification example;

FIGS. 13A to 13C illustrate a fourth modification example of the feed member, the sensing part, and the periphery thereof, wherein FIG. 13A is a front view illustrating a state where the feed member applies a load to a sheet, FIG. 13B i s a front view illustrating a state where the feed member does not apply a load to a sheet, and FIG. 13C is a side view illustrating the state illustrated in FIG. 13B;

FIGS. 14A and 14B illustrate a modification example of a sensing part attached to a rear end load applicator, wherein FIG. 14A is a side view illustrating the modification example of the sensing part, and FIG. 14B is a horizontal cross-sectional view illustrating the modification example of the sensing part;

FIGS. 17A and 17B depict a separator, a feed device, a pressing device, and a transport condition sensing device, wherein FIG. 17A is a right side view and FIG. 17B is a plan view;

FIGS. 21A and 21B depict a second modification example of the transport condition sensing device included in the image forming apparatus according to the second exemplary embodiment of the invention, wherein FIG. 21A is a right side view when sheet is not floated and FIG. 21B is a right side view when sheet on top of sheet stack is floated;

FIGS. 24A and 24B illustrate a transport condition sensing device included in an image forming apparatus according to a third exemplary embodiment of the invention, wherein FIG. 24A is a right side view and FIG. 24B is a plan view.

FIGS. 27A and 27B depict a float condition sensing device included in an image forming apparatus according to a fourth exemplary embodiment of the invention, wherein FIG. 27A is a right side view and FIG. 27B is a plan view;

DETAILED DESCRIPTION

In the following, a first exemplary embodiment of the invention will be described based on the drawings.

Figure 1:
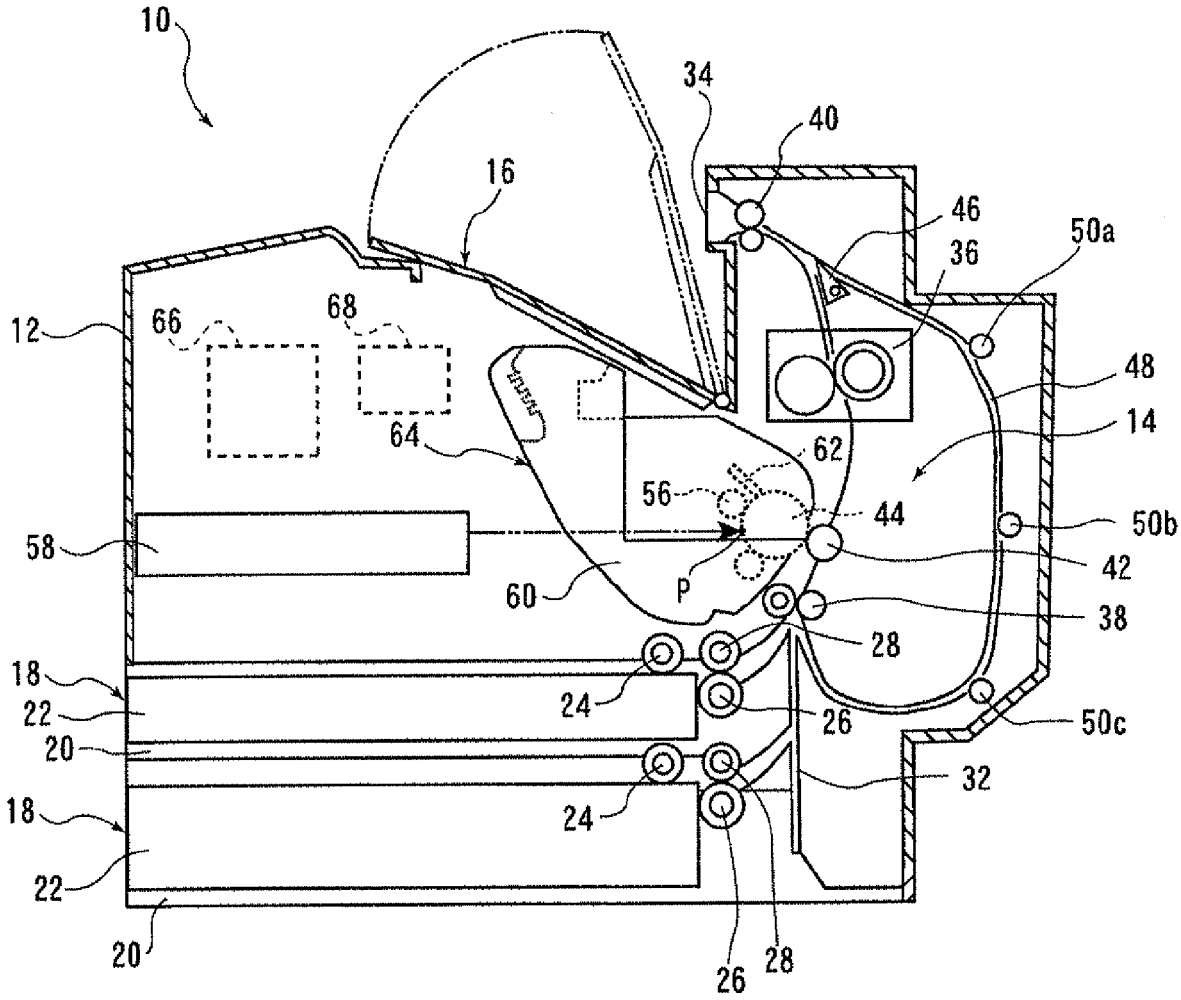
FIG. 1 is a side view depicting an outline of an image forming apparatus according to an exemplary embodiment of the invention.
Figure 2:
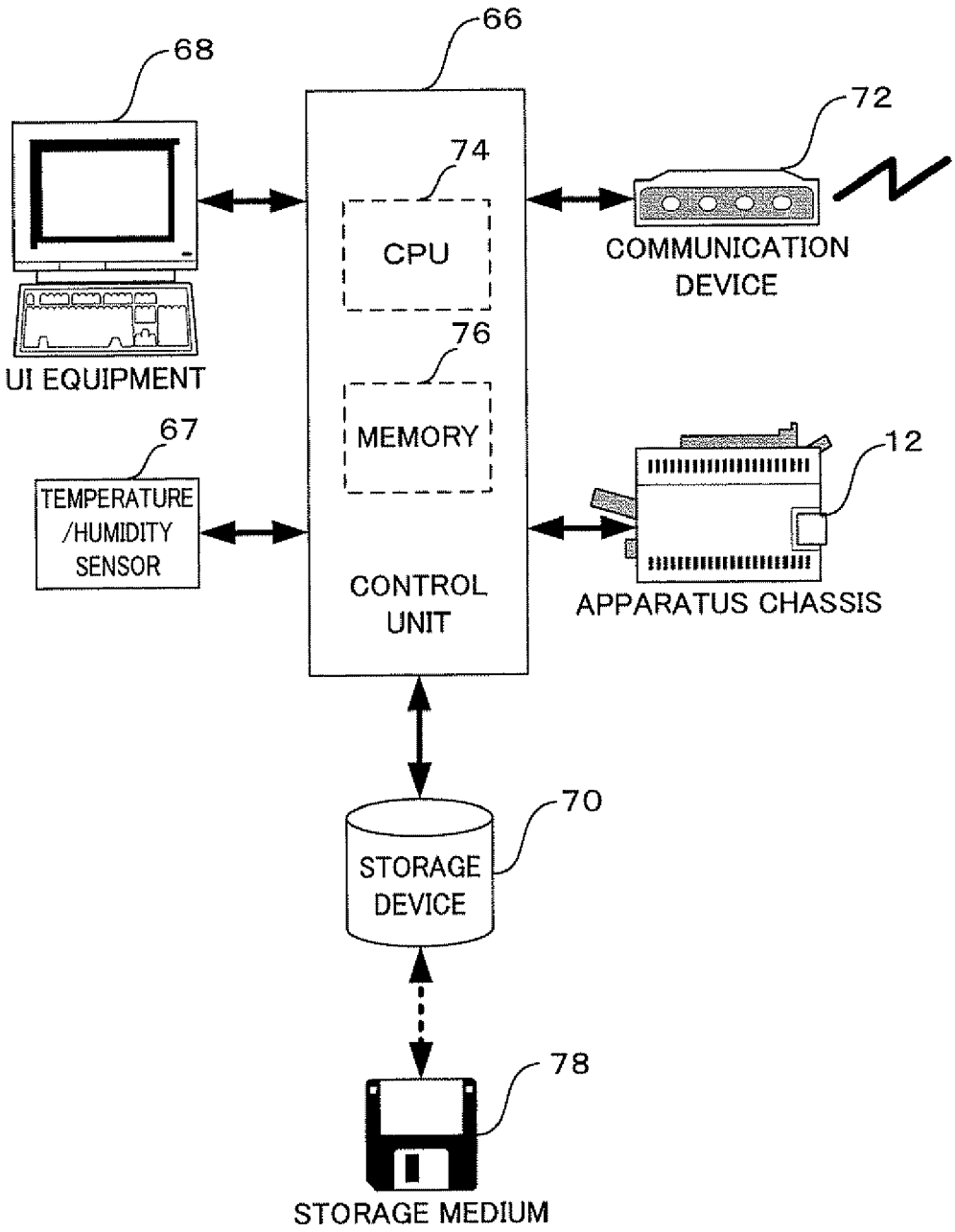
FIG. 2 is a system diagram illustrating an overview of the image forming apparatus according to an exemplary embodiment of the invention.

In FIGS. 1 and 2, an outline of an image forming apparatus 10 according to a first exemplary embodiment of the invention is depicted. The image forming apparatus 10 has an apparatus chassis 12 and an image forming part 14 is installed in the apparatus chassis 12. There is an output tray 16 which will be described later on the top of the apparatus chassis 12 and sheet feed units 18 (sheet feed devices) in, e.g., two stages are disposed in the lower part of the apparatus chassis 12. Besides, plural sheet feed units may be disposed optionally in the lower part of the apparatus chassis 12.

Each sheet feed unit (sheet feed device) 18 has a unit chassis 20 and a sheet cassette 22 in which sheets such as plural sheets of sheet can be stacked. Above and near the rear end of the sheet cassette 22 (the forward end in the sheet transport direction), a feed member 24 is disposed and a retard roller 26 and a feed roller 28 are disposed after the feed member 24. The feed roller 28 is driven by a driving unit which is not shown and rotates to make a sheet go ahead toward a main transport path 32 which will be described later. The retard roller 26 is pressed against the feed roller 28 so as to be rotatable with the rotation of the feed roller 28 and rotates to make a sheet one by one go toward the main transport path 32 in cooperation with the feed roller 28. For examplar when plural sheets are caught between the feed roller 28 and the retard roller 26, the retard roller 26 allows only the top sheet to slide in the layered sheets and prevents a sheet not in contact with the feed roller 28 from going ahead. Thereby, the retard roller 25 serves to separate one sheet from another and feed only the top sheet to the main transport path 32.

The main transport path 32 is a sheet passage from the feed roller 28 to the outlet 34. The main transport path 32 is provided in the rear section (right side in FIG. 1) of the apparatus chassis 12 and has a nearly vertical portion from the lowest sheet feed unit 18 to a fixing device 36 which will be described later. Along the main transport path 32, upstream of the fixing device 36, a transfer device 42 and an image carrying body 44, which will be described later, are disposed. Further, registration rollers 38 are disposed upstream of the transfer device 42 and the image carrying body 44. The registration rollers once stop a sheet traveling in the main transport path 32 and guide the sheet into between the transfer device 42 and the image carrying body 44 at a given timing.

Further, eject rollers 40 are disposed near the outlet 34 of the main transport path 32.

Accordingly, when a sheet is fed by the feed member 24 from the sheet cassette 22 of the sheet feed unit, its separation from another sheet is ensured by the cooperation of the retard roller 26 and the feed roller 28 and only the top sheet is guided to the main transport path 32. The sheet is once stopped by the registration rollers 38 and, at a proper timing, guided into between the transfer device 42 and the image carrying body 44 which will be described later. At this time, a developer image is transferred to the sheet and the transferred developer image is then fixed by the fixing device 36. Thereafter, the sheet is rejected by the reject rollers 40 from the outlet 34 to the output tray 16.

In the case of both side printing, however, the sheet gets back to a reverse path. Specifically, there is a two-way divergence just before the eject rollers 40 and a switching mechanism 46 is provided at the divergence. The reverse path 48 is formed from the divergence to the divergence to the registration rollers 38. Transport rollers 50*a* to 50*c* are provided along the reverse path 48. In the case of both side printing, the switching mechanism 46 is placed to a position to open the reverse path 48 and the eject rollers 40 start to rotate reversely with the sheet being caught by these rollers just before the posterior edge of the sheet. Thereby, the sheet is guided to the reverse path 48 and passes between the registration rollers 38, between the transfer device 42 and the image carrying body 44, and through the fixing device 36. Eventually, the sheet is ejected from the outlet 34 to the output tray 16.

The image forming part 14 is, for example, of an electrophotographic type, and is composed of the following: an image carrying body 44 such as a photoreceptor; a charging device 56 that charges the image carrying body 44 evenly, wherein the charging device 56 is formed of, for example, a charging roller; an optical exposure device 58 that, by light irradiation, projects a latent image onto the image carrying body 44 charged by the charging device 56; a development device 60 that applies a developer to a latent image formed on the image carrying body 44 by the optical exposure device 58, thus making the latent image visible; a transfer device 42 such as, for example, a transfer roller that transfers a developer image created by the development device 60 onto a sheet; a cleaning device 62 such as, for example, a blade that clears remaining developer particles from the image carrying body 44; and a fixing device 36 that fuses and fixates the developer image on the sheet, transferred by the transfer device 42, to the sheet. The optical exposure device 58 is formed of, for example, a scan-type laser illumination device. This device 58 is placed in parallel with the above sheet feed units 18 in the front section of the apparatus chassis 12 and emits light that passes across the development device 60 and irradiates the image carrying body 44. The optical exposure device 58 irradiates the image carrying body 44 under the control of control unit 66 which will be described later. The light irradiation position on the image carrying body 44 corresponds to a latent image projection position P.

A process cartridge 64 is a cartridge in which the image carrying body 44, the charging device 56, the development device 60, and the cleaning device 62 are integrated and allows these components to be replaced all together. By opening the output tray 16, the process cartridge 64 can be accessed and removed from the apparatus chassis 12.

The image forming apparatus 10 also involves a control unit 66, a temperature/humidity sensor 67, user interface equipment (UI equipment) 68 including a display, keyboard, etc., a storage device 70 such as a HDD or CD unit, a communication device 72, and others. The control unit 66 includes, inter alia, a CPU 74 and a memory 76 and controls each of the components of the image forming apparatus 10. The temperature/humidity sensor 67 detects and outputs temperature and humidity (environmental conditions) to the control unit 66.

Thus, the image forming apparatus 10 includes functionality as a computer and performs print operation and processing such as adjusting an air flow generated by an air blow device 90 which will be described later by executing a program preinstalled from a storage medium 78 or via the communication device.

The UI equipment 68 may be adapted to output information about a sheet position according to a result encoded by an encoder 82, 108 which will be described later.

Then, a first exemplary embodiment of a sheet feed unit 18 is described.

Figure 3:
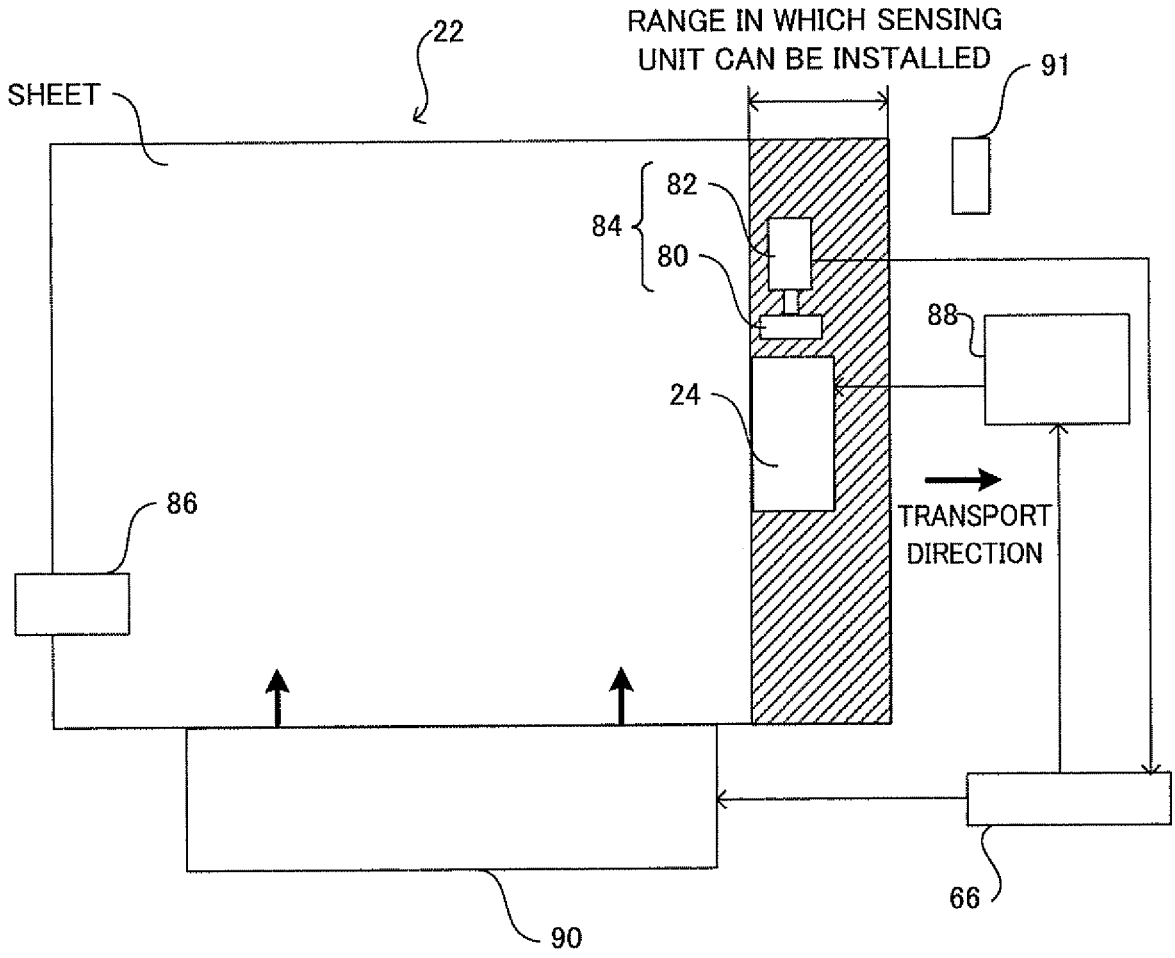
FIG. 3 schematically illustrates a first exemplary embodiment of a sheet feed unit and its periphery, viewed from above.

FIG. 3 schematically illustrates an outline of the first exemplary embodiment of the sheet feed unit 18 and its periphery, viewed from above. In the sheet feed unit 18, the feed member 24 is disposed in the forward end in the sheet transport direction, as mentioned above. The sheet feed unit 18 is also provided with a sensing part 84 formed of a sensing roller 80 that rotates about its rotating shaft which is substantially parallel with the rotating shaft of the feed member 24 and an encoder 82 that encodes the amount of rotation of the sensing part 84 (corresponding to the position or slid state of a fed sheet) and a rear end load applicator 86 that applies a load to a sheet from above. The sensing part 84 may be an optical sensor or the like that senses information about the displaced distance of a sheet without contacting with the sheet.

The feed member 24 is arranged such that a load applied to the top one of sheets stacked in the sheet cassette 22 is adjusted by a load adjustment device 88 which operates under control of the control unit 66. The sensing roller 80 contacts with the top one of sheets stacked in the sheet cassette 22 and rotates with the travel (moving) of a sheet fed by the feed member 24. The encoder 82 encodes the amount of rotation of the sensing roller 80 and outputs the encoded result to the control unit 66.

On one side of the sheet cassette 22, there is an air blow device (air flow generating unit) 90 that blows air toward a substantially perpendicular direction with respect to the sheet transport direction to blow the air against the sheets stacked in the sheet cassette 22. The air blow device 90 is removably installed in the apparatus chassis 12. The air blow device 90 blows air in a region between the feed member 24 and the rear end load applicator 86 to blow the air against the sheets stacked in the sheet cassette 22, wherein a load is applied to the top sheet from above by the feed member 24 and the rear end load applicator 86. In this way, the air blow device 90 allows a sheet to float by air blow towards the sheets. This releases the sheets from tending to cling to each other and helps the feed member 24 for discharging a sheet.

Downstream of the sheet cassette 22 in the sheet transport direction, a sheet sensor 91 is disposed for sensing the passage of a sheet or its positional information.

Here, the sensing part 84 and the rear end load applicator 86 are located outside of the path of the air blew by the air blow device 90 so that they do not obstruct the air flow produced by the air blow device 90. For example, the sensing part 84 is located downstream of the feed member 24 in the air blow direction from the air blow device 90. The sensing part 84 may be located, for example, ahead of the feed member 24 in the sheet transport direction or may be located such that its forward end in the sheet transport direction generally corresponds to the position of the feed member 24 (within a range in which the sensing part 84 can be installed, which is represented by a shaded region in FIG. 3).

Next, the feed member 24, the sensing part 84, and the periphery thereof are described in detail.

Figure 4A:
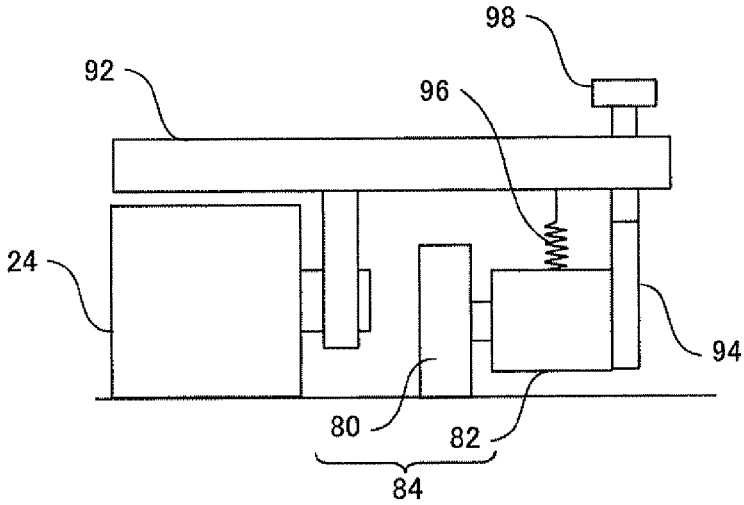
Figure 4B:
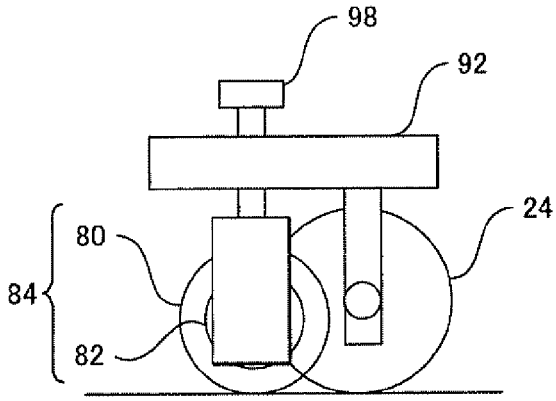
Figure 4C:
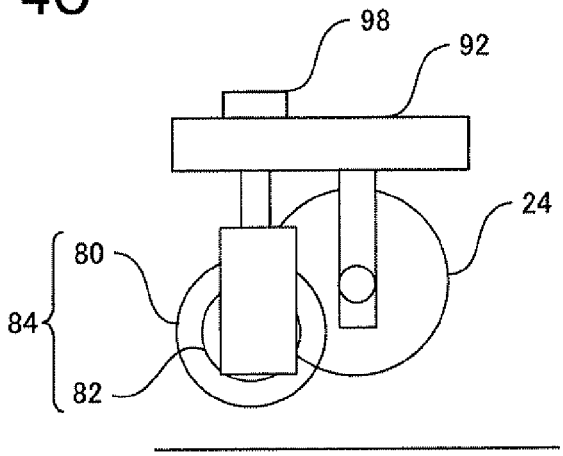

FIGS. 4A to 4C are enlarged views of the feed member 24, the sensing part 84, and the periphery thereof. FIG. 4A is an enlarged front view when the feed member 24 applies a load to a sheet. FIG. 4B is an enlarged side view when the feed member 24 applies a load to a sheet. FIG. 4C is an enlarged side view when the feed member 24 does not apply a load to a sheet (unloaded state).

The feed member 24 is rotatably supported by a support member 92 and allowed to apply a load to a sheet. The sensing part 84 is supported by a support member 94 and urged by an elastic member 96 such as, for example, a spring so that the sensing roller 80 is allowed to contact with a sheet. The support member 94 is allowed to be displaced in a substantially vertical direction with respect to the support member 92 and is provided with a stopper 98 at its top end. The stopper 98 restricts the moving of the support member 94 with respect to the support member 92.

Thus, as illustrated in FIGS. 4A and 4B, when the support member 92 is pressed downward by an elastic member which is not shown so that feed member 24 applies a given load to a sheet, the support member 94 is brought in contact with a sheet by the urging force of the elastic member 96.

On the other hand, as illustrated in FIG. 4C, when the support member 92 is lifted upward by the elastic member not shown so that the feed member 24 is pulled off a sheet, the support member 94 moves downward with respect to the support member 92 by the urging force of the elastic member 96 to the stop position by the stopper 98 and comes off a sheet.

Figure 5:
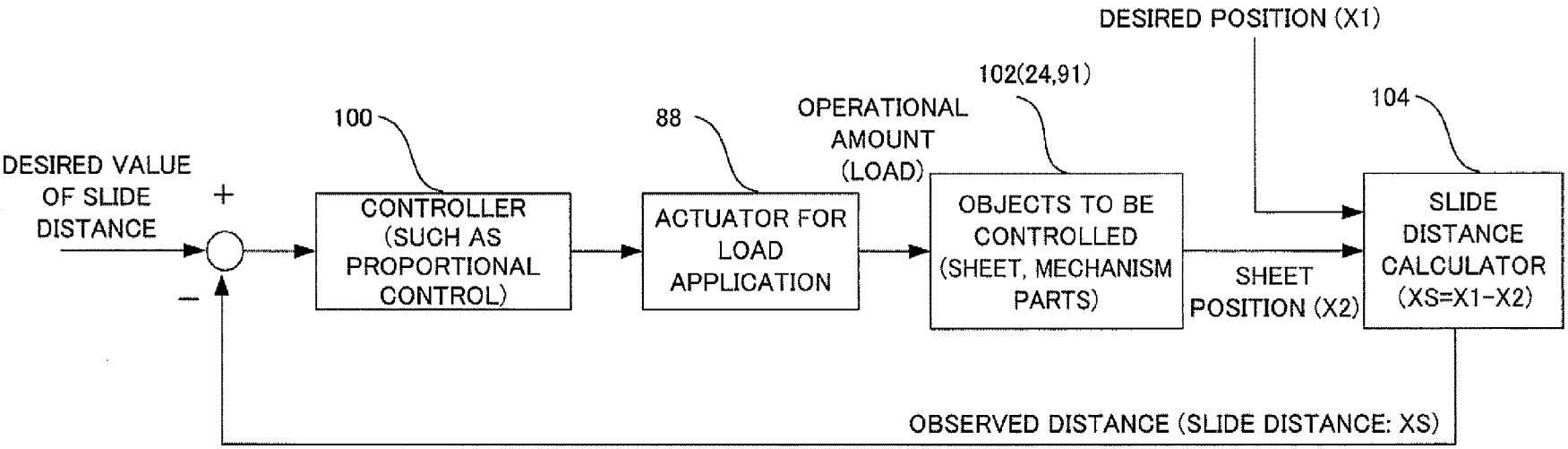
FIG. 5 is a conceptual diagram illustrating a first example of an arrangement of a control system for a sheet feed unit.

FIG. 5 is a conceptual diagram illustrating a first example of an arrangement of a control system for a sheet feed unit 18. The control system for the sheet feed unit 18 is composed of a controller 100 included in the control unit 66, a load adjustment device (an actuator for load application) 88, objects 102 to be controlled, and a slide distance calculator 104. The controller 100 receives a certain desired value of slide distance for the feed member 24 and a result of calculation by the slide distance calculator 104 and performs control such as a proportional control of the load adjustment device 88. The load adjustment device 88 effects control of the objects 102 to be controlled by displacing the position of the feed member 24 by an operational amount according to the control of the controller 100. The objects 102 to be controlled include the feed member 24, the sheet sensor 91, and sheets. According to the control of the load adjustment device 88, the feed member 24 applies a certain load to a sheet and the sheet sensor 91 outputs a value of a sheet position (X2) to the slide distance calculator 104. The slide distance calculator 104 receives a value of a desired sheet position (X1) which has been stored, for example, in the memory 76 and a value of the sheet position (X2) output by the object 102 to be controlled, calculates the slide distance of a sheet (XS=X1−X2), and feeds the calculation result (observed distance) back to the controller 100.

Figure 6:
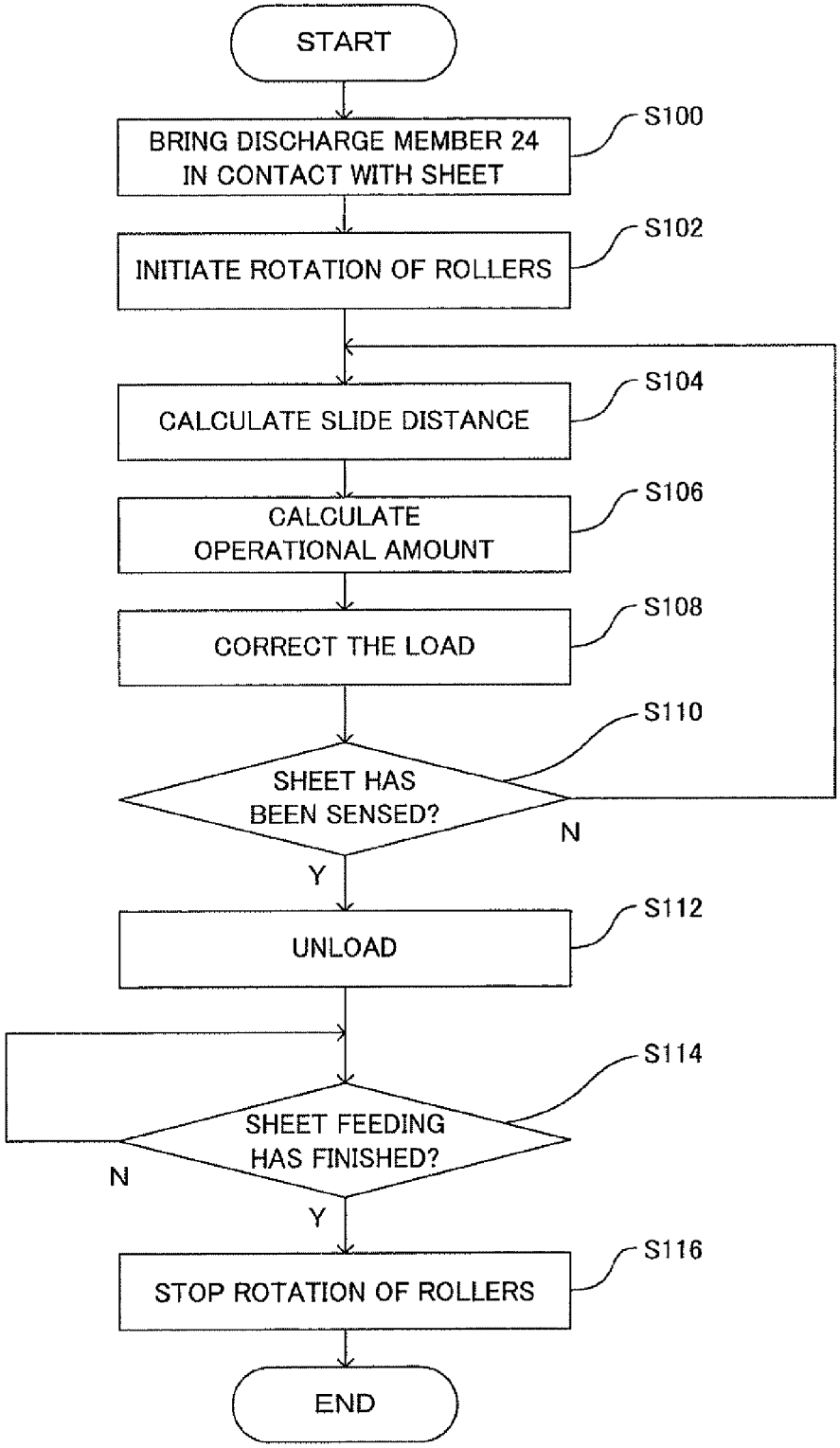
FIG. 6 is a flowchart illustrating a process (S10) in which the control unit controls a load that the feed member applies to a sheet.

FIG. 6 is a flowchart illustrating a process (S10) in which the control unit 66 controls a load that the feed member 24 applies to a sheet.

As illustrated in FIG. 6, at step 100 (S100), the control unit 66 brings the feed member 24 in contact with a sheet via the load adjustment device 88.

At step 102 (S102), the control unit 66 starts the rotation of the rollers such as the feed member 24, the feed roller 28, and the retard roller 26.

At step 104 (S104), the slide distance calculator 104 calculates the slide distance of a sheet (XS=X1−X2).

Figure 7:
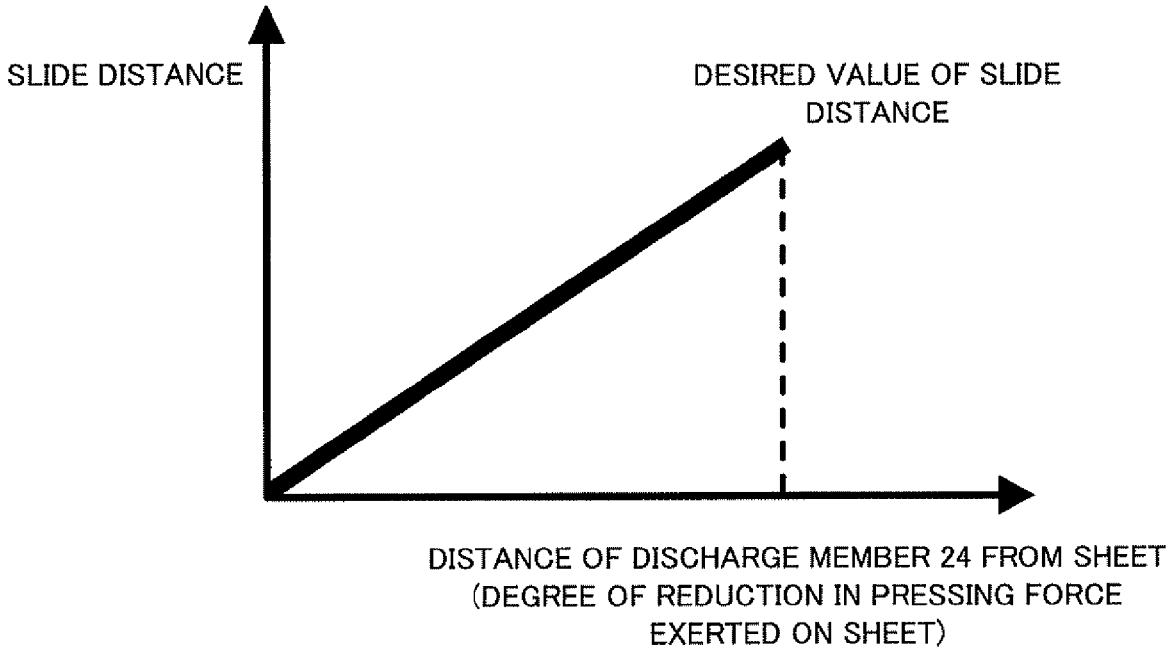
FIG. 7 is a graph representing change in the slide distance depending on the distance of the feed member from a sheet.

At step 106 (S106), the control unit 66 calculates an operational amount for the load adjustment device 88 to make the slide distance calculated by the slide distance calculator 104 equal to the desired value of slide distance illustrated in FIG. 7.

The sheet slide distance should be substantially proportional to the distance of the feed member 24 from the sheet (a degree of reduction in the pressing force exerted on the sheet), as illustrated in FIG. 7.

At step 108 (S108), the load adjustment device 88 corrects the load that the feed member 24 applies to a sheet, according to the operational amount calculated by the control unit 66.

At step 110 (S110), control unit 66 determines whether the sheet sensor 91 has sensed the sheet. If the sheet has been sensed, as determined, the process goes to step S112; if not, the process goes to step S104.

At step 112 (S112), the control unit 66 displaces the feed member 24 to a position where no load is applied to a sheet (unload) via the load adjustment device 88.

At step 114 (S114), the control unit 66 determines whether sheet feeding to the image forming part 14 has finished. If sheet feeding has finished, the process goes to step S116; if not, the process is continued.

At step 116 (S116), the control unit 66 stops the rotation of the rollers such as the feed member 24, the feed roller 28, and the retard roller 26.

Next, a second exemplary embodiment of a sheet feed unit 18 is described.

Figure 8:
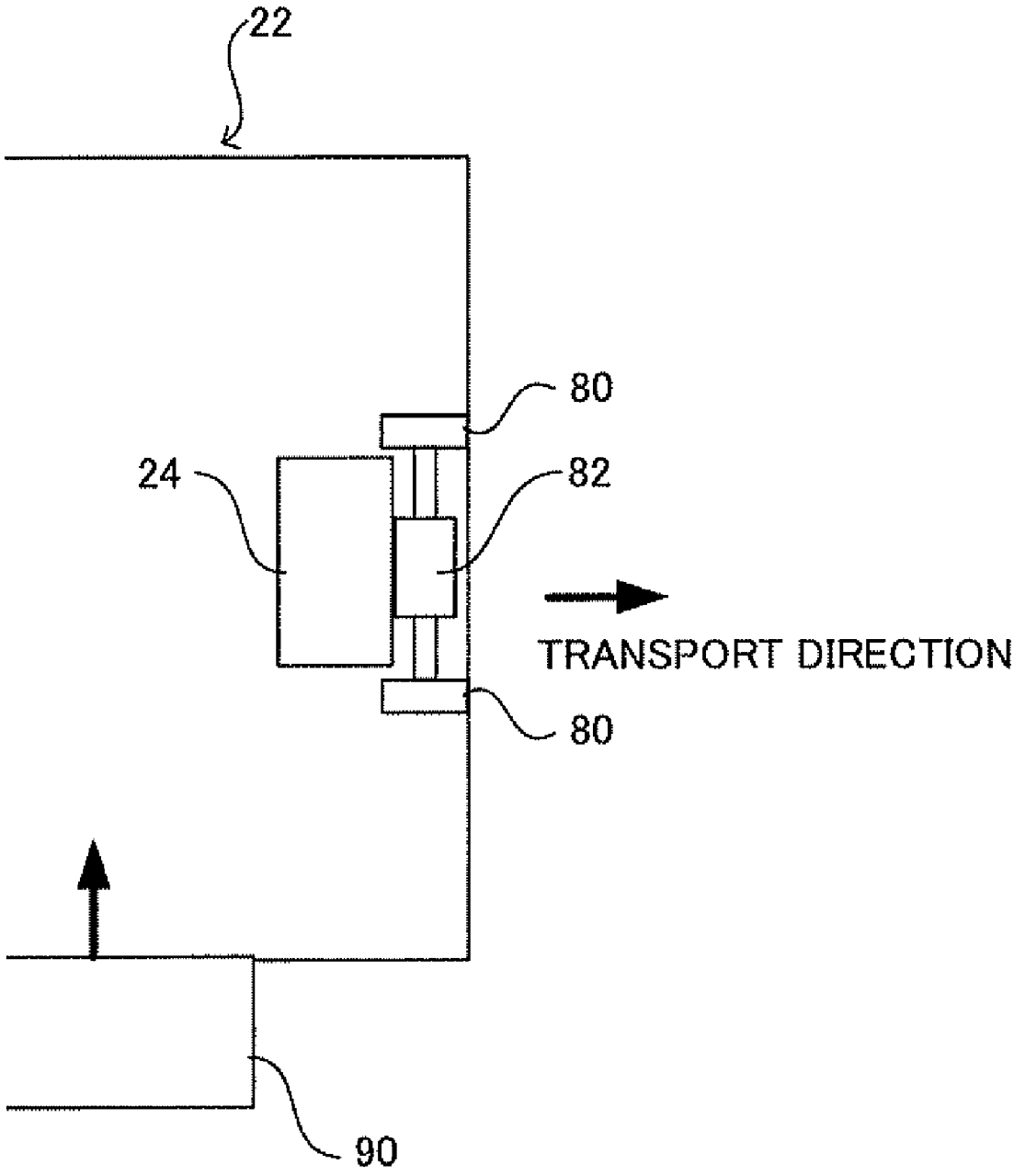
FIG. 8 schematically illustrates a second exemplary embodiment of a sheet feed unit and its periphery, viewed from above.

FIG. 8 schematically illustrates a second exemplary embodiment of a sheet feed unit 18 and its periphery, viewed from above. As illustrated in FIG. 8, the sheet feed unit 18 may be arranged such that the encoder 82 encodes the amounts of rotation of two sensing rollers 80 provided in both ends. In the case where the air blow device 90 that blows air toward a substantially perpendicular direction with respect to the sheet transport direction, the encoder 82 and sensing rollers 80 may be positioned downstream of the feed member 24 in the sheet transport direction.

Figure 9:
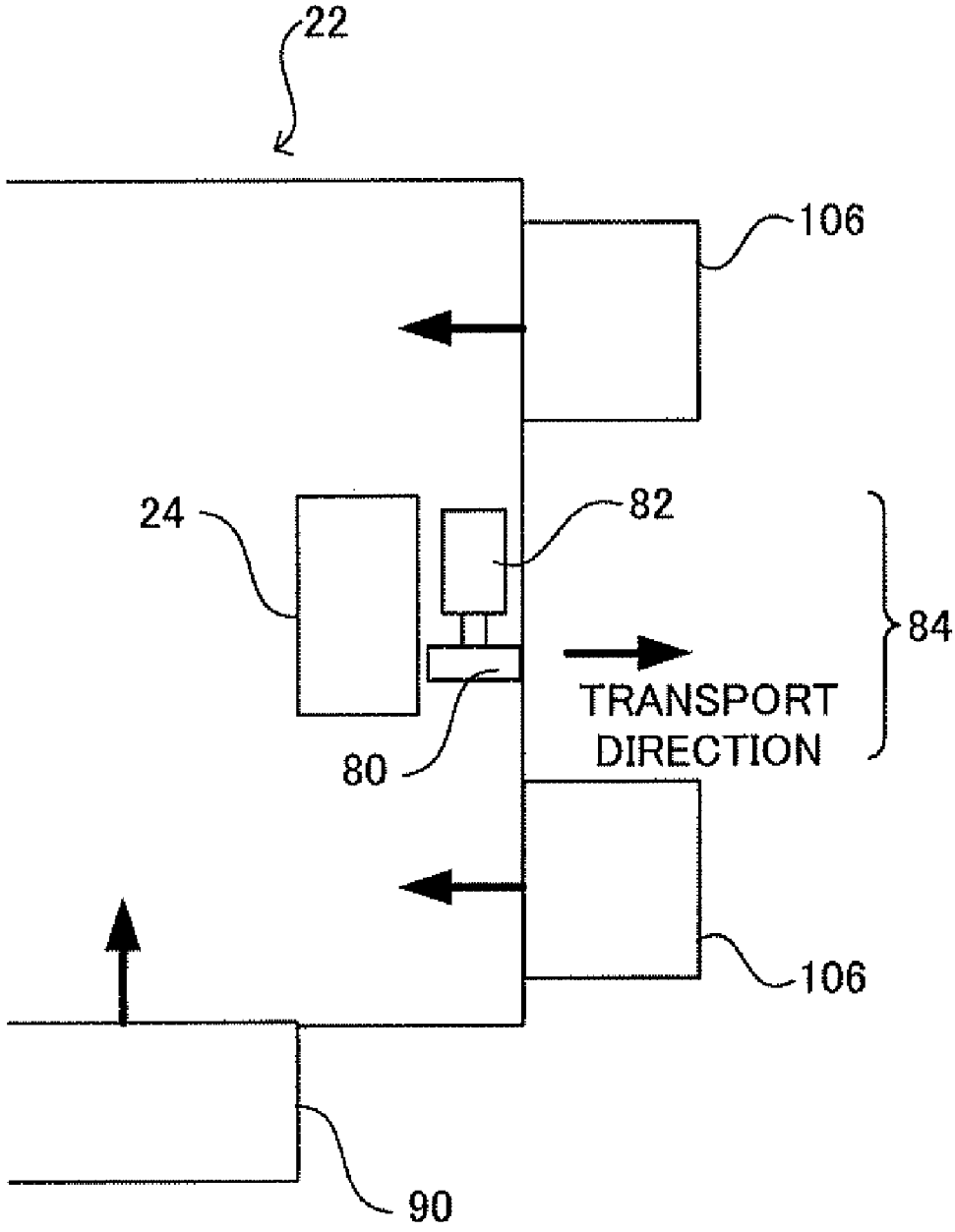
FIG. 9 schematically illustrates a third exemplary embodiment of a sheet feed unit and its periphery, viewed from above.

FIG. 9 schematically illustrates a third exemplary embodiment of a sheet feed unit 18 and its periphery, viewed from above. As illustrated in FIG. 9, in a variation of the sheet feed unit 18, additional air blow devices 106 may be provided to blow air against the sheet cassette 22 from downstream in the sheet transport direction.

Here, the sensing part 84 and the feed member 24 are installed outside of the paths of air blew from the air blow device 90 and the air blow devices 106 so as not to obstruct the air flow produced by the air blow device 90 as well as the air flows produced by the air blow devices 106.

Figure 10:
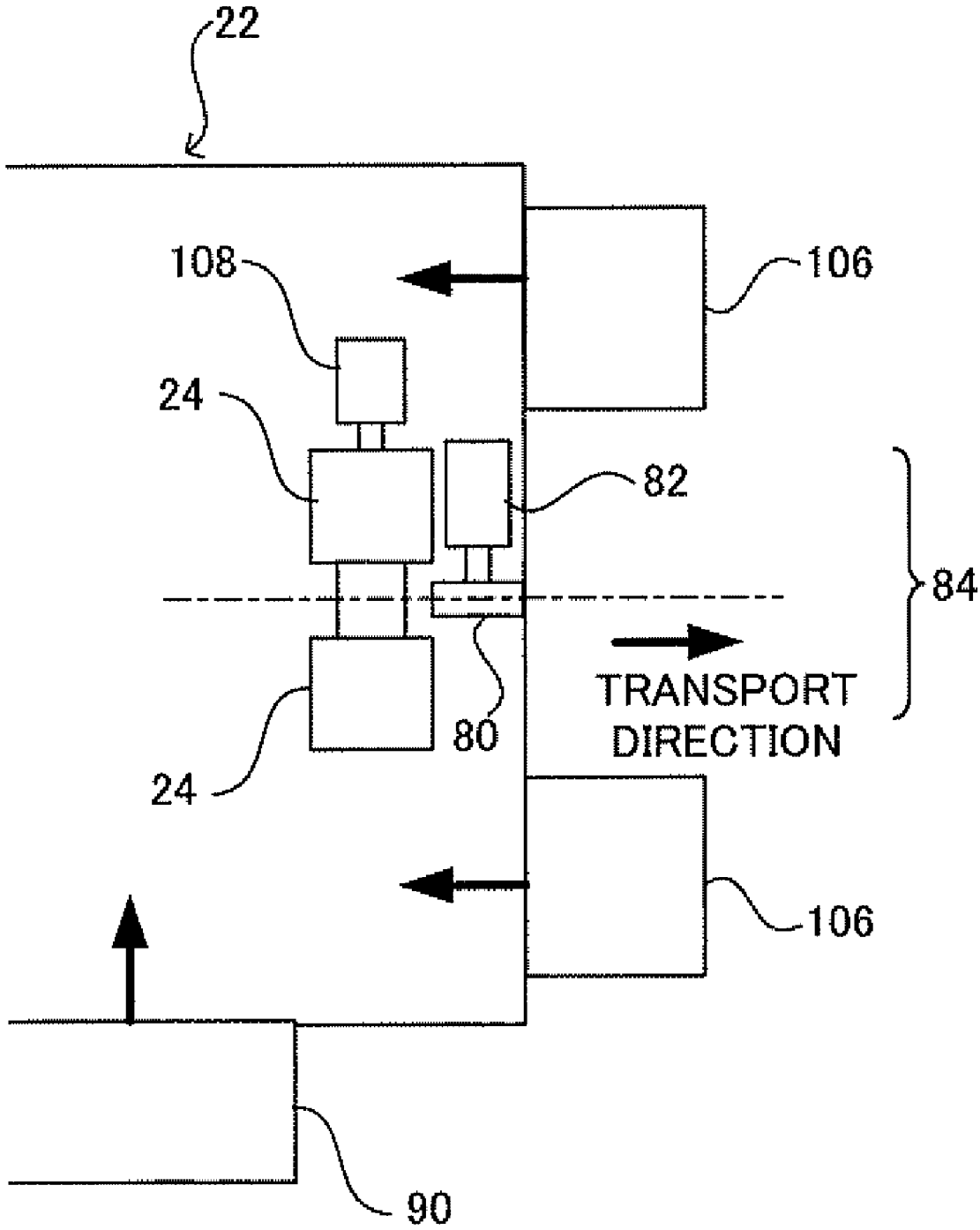
FIG. 10 schematically illustrates a fourth exemplary embodiment of a sheet feed unit and its periphery, viewed from above.

FIG. 10 schematically illustrates a fourth exemplary embodiment of a sheet feed unit 18 and its periphery, viewed from above. As illustrated in FIG. 10, a variation of the sheet feed unit 18 may be provided with the air blow device 90 that blows air toward a substantially perpendicular direction with respect to the sheet transport direction and the air blow devices 106 that blow air against the sheet cassette 22 from downstream in the sheet transport direction. Additionally, the sheet feed unit 18 may be configured with an encoder 108 attached to feed members 24 rotating coaxially and an encoder 82 that encodes the amount of rotation of the sensing roller 80.

Here, the sensing part 84 and feed members 24 are installed as far as possible outside of the paths of air blew from the air blow device 90 and the air blow devices 106 so as to avoid, if at all possible, obstructing the air flow produced by the air blow device 90 as well as the air flows produced by the air blow devices 106.

Figure 11:
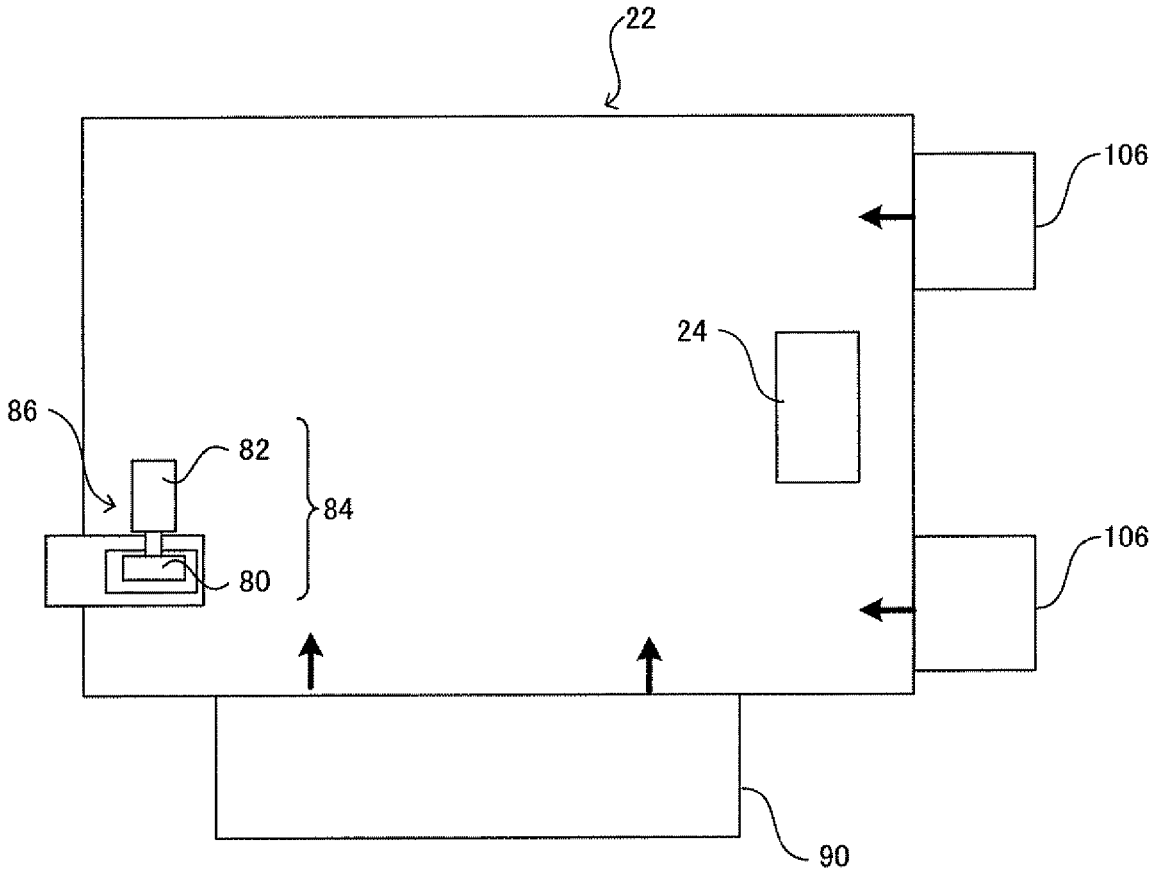
FIG. 11 schematically illustrates a fifth exemplary embodiment of a sheet feed unit and its periphery, viewed from above.

FIG. 11 schematically illustrates a fifth exemplary embodiment of a sheet feed unit 18 and its periphery, viewed from above. As illustrated in FIG. 11, a variation of the sheet feed unit 18 may be provided with the air blow device 90 that blows air toward a substantially perpendicular direction with respect to the sheet transport direction and the air blow devices 106 that blow air against the sheet cassette 22 from downstream in the sheet transport direction. In this sheet feed unit 18, the sensing part 84 may be attached to the rear end load applicator 86.

Here, the sensing part 84 and feed member 24 are installed as far as possible outside of the paths of air blew from the air blow device 90 and the air blow devices 106 so as not to directly obstruct the air flow produced by the air blow device 90 as well as the air flows produced by the air blow devices 106.

Next, modification examples of the feed member 24, the sensing part 84, and the periphery thereof are described.

Figure 12A:
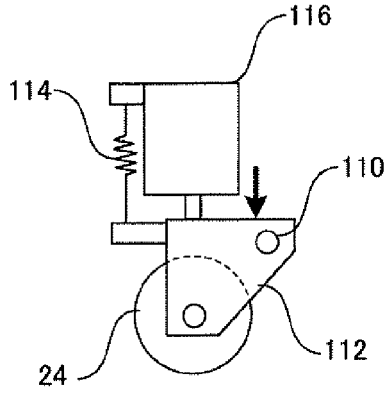
Figure 12B:
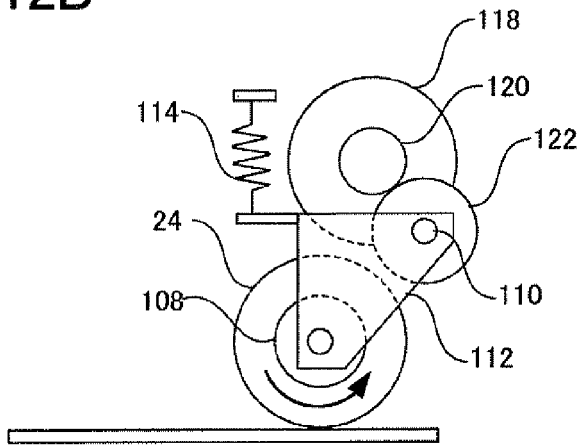
Figure 12C:
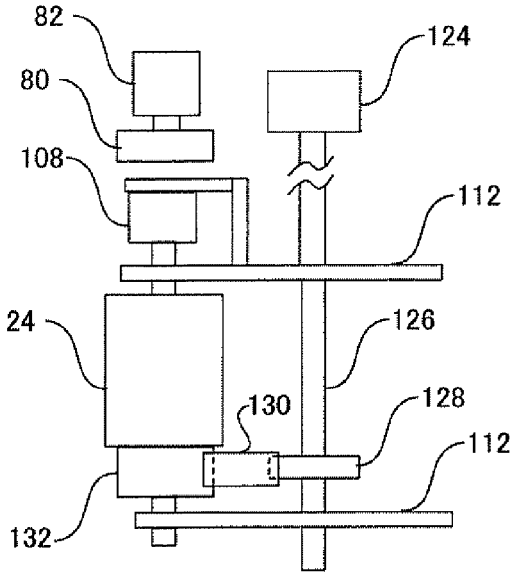

FIGS. 12A to 12C illustrate modification examples of the feed member 24, the sensing part 84, and the periphery thereof. FIG. 12A is a side view illustrating a first modification example. FIG. 12B is a side view illustrating a second modification example. FIG. 12C is a top view illustrating a third modification example.

As illustrated in FIG. 12A, the feed member 24 is supported by a support member 112 that can be swayed around a shaft 110. A voice coil motor 116 moves up and down the support member 112 that can be pulled up by an elastic member 114 such as, for example, a spring. Thereby, the feed member 24 may be displaced vertically to apply a load to a sheet and unload.

As illustrated in FIG. 12B, the feed member 24 and the encoder 108 are supported by the support member 112 that can be swayed around the shaft 110. A rotary DC motor 118 moves up and down the support member 112 that can be pulled up by an elastic member 114 such as, for example, a spring, via gears 120, 122. Thereby, the feed member 24 may be displaced vertically to apply a load to a sheet and unload.

As illustrated in FIG. 12C, the feed member 24 is driven by the rotation of a rotary motor 124 via a shaft 126 and gears 128, 130, 132. The amount of rotation of the feed member 24 and the amount of rotation of the sensing roller 80 are detected by encoders 108, 82, respectively. Thereby, the control unit 66 may control the vertical moving of the feed member 24 that applies a load to a sheet and unload.

Figure 13A:
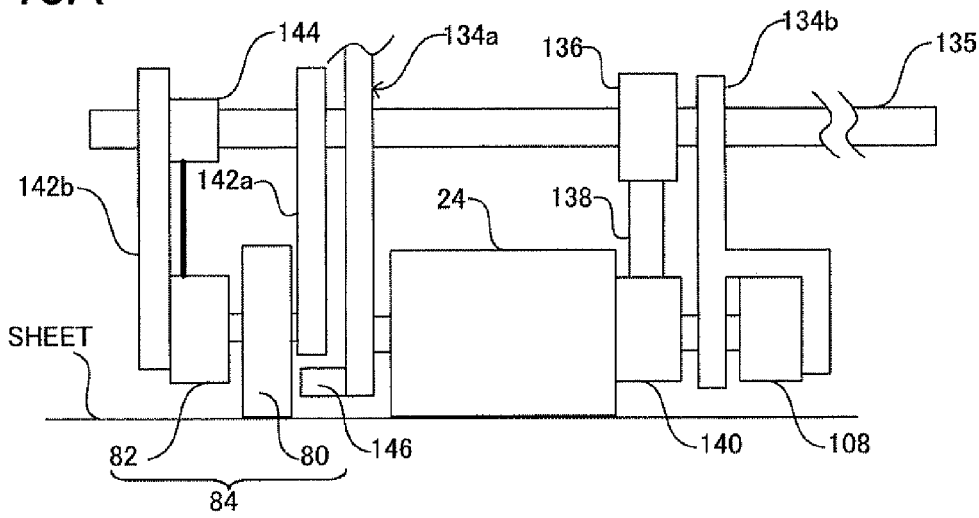
Figure 13B:
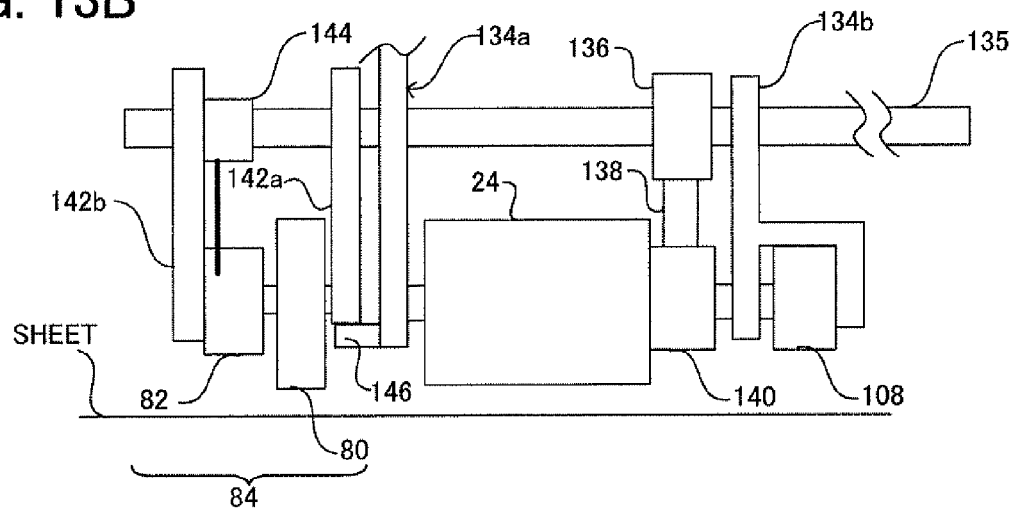
Figure 13C:
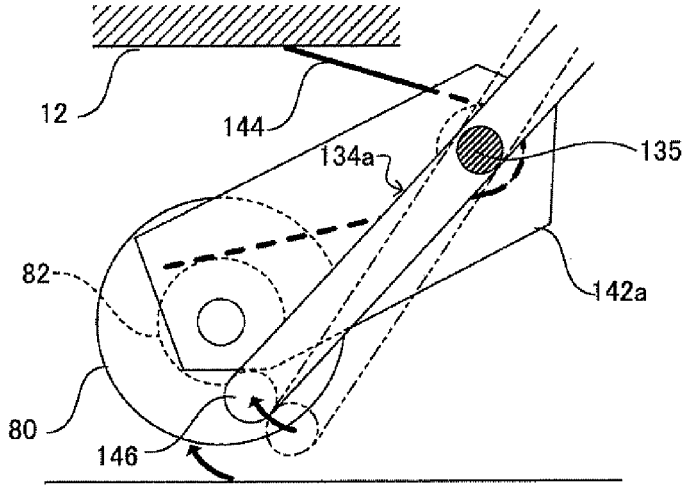

FIGS. 13A to 13C illustrate a fourth modification example of the feed member 24, the sensing part 84, and the periphery thereof. FIG. 13A is a front view illustrating a state where the feed member 24 applies a load to a sheet. FIG. 13B is a front view illustrating a state where the feed member 24 does not apply a load to a sheet. FIG. 13C is aside view illustrating the state illustrated in FIG. 13B.

The feed member 24 and the encoder 108 are supported by support members 134*a*, 134*b*. The support members 134*a*, 134*b* can be swayed around a shaft 135 according to control of the control unit 66 (not shown). The shaft 135 on which a gear 136 is fixed is driven by a driver not which is not shown. As the shaft 135 is driven, the feed member 24 rotates via gears 136, 138, 140. The encoder 108 encodes the amount of rotation of the feed member 24. The sensing roller 80 and the encoder 82 are supported by support members 142*a*, 142*b*. The sensing roller 80 is urged downward by a spring 144 via the encoder 82. As the support members 134*a*, 134*b* displace the feed member 24 downward to contact with a sheet, the sensing roller 80 starts to rotate in contact with a sheet fed by the feed member 24.

The support member 134*b* is provided with a lifting part 146. Under control of the control unit 66, as the support members 134*a*, 134*b* move upward, the feed member 24 moves up off the sheet. At the same time, the support member 142*a* is lifted by the lifting part 146 and the sensing roller 80 also comes off the sheet. Thus, when the load that the feed member 24 applies to a sheet is adjusted by the control unit 66, the sensing part 84 is displayed in conjunction with the moving of the feed member 24.

Figure 14A:
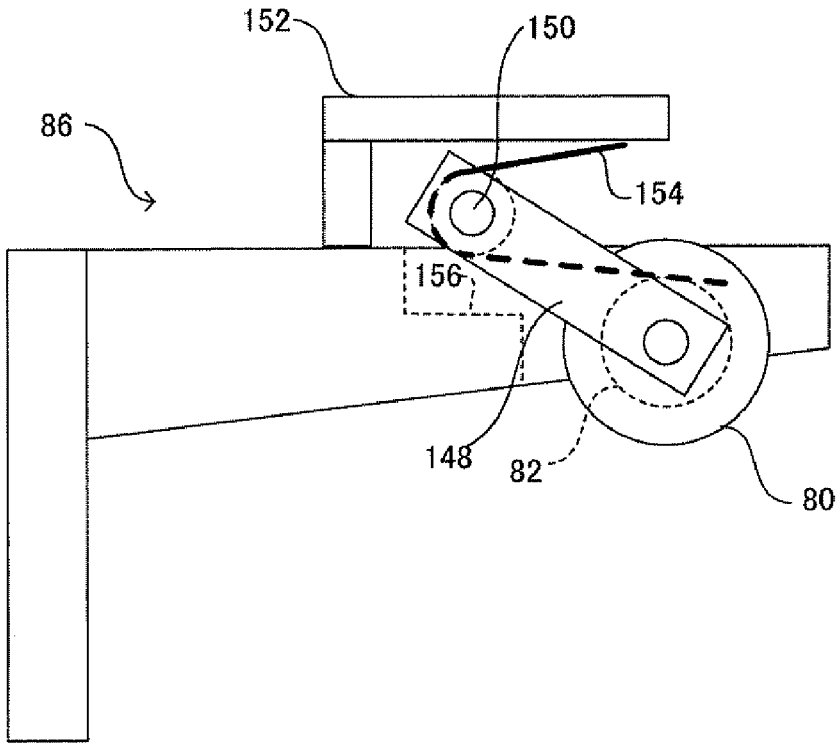
Figure 14B:
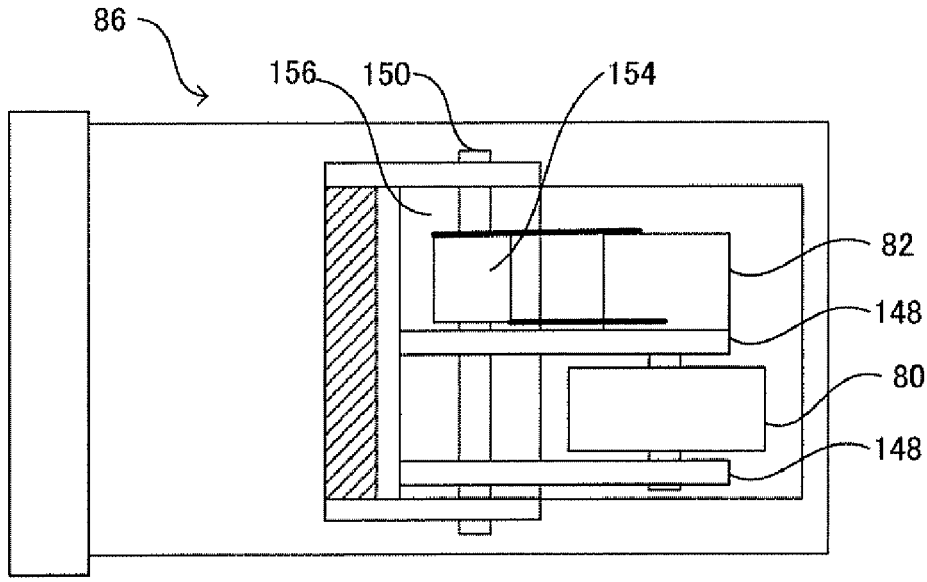

FIGS. 14A and 14B illustrate a modification example of the sensing part 84 attached to the rear end load applicator 86. FIG. 14A is a side view illustrating the modification example of the sensing part 84. FIG. 14B is a horizontal cross-sectional view illustrating the modification example of the sensing part 84. The sensing roller 80 and the encoder 82 are supported by a support member 148. The support member 148 can be swayed around a shaft 150 and is urged by a spring 154, one end of which is fixed by a spring support member 152. By this urging force, the sensing roller 80 applies a load to the rear end of the top sheet out of the sheets stacked in the sheet cassette 22. Hence, when the top sheet is feedd by the feed member 24, the sensing roller 80 is brought in contact with the top sheet out of the sheet stack in the sheet cassette 22 and rotates as the sheet travels (the sheet is displaced). The encoder 82 encodes the amount of rotation of the sensing roller 80 and outputs the encoded result to the control unit 66. The downward moving of the support member 148 is restricted by a stopper 156.

Next, a second example of an arrangement of a control system for a sheet feed unit 18 is described.

Figure 15:
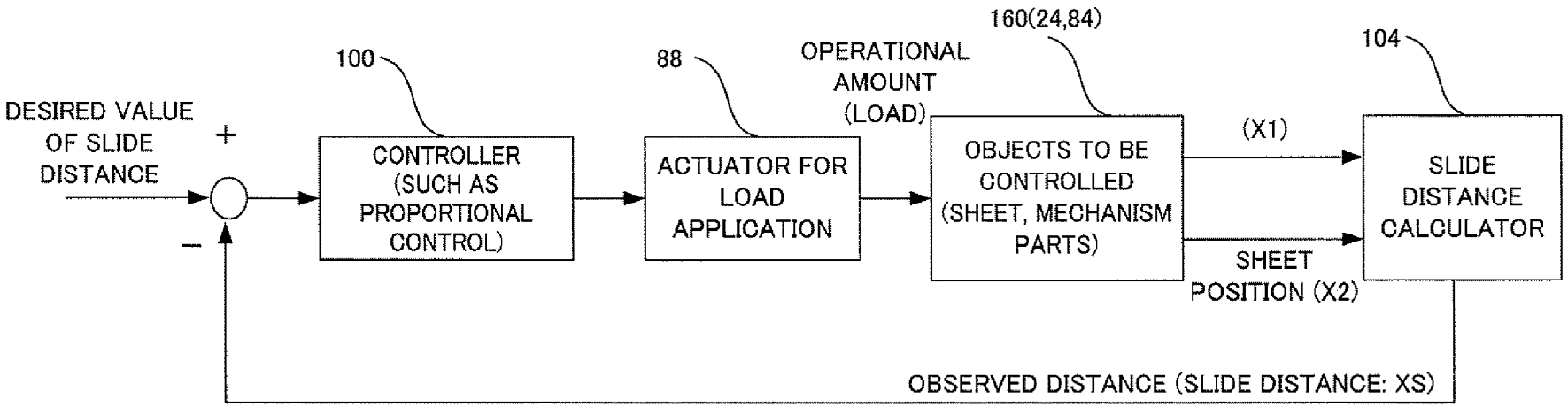
FIG. 15 is a conceptual diagram illustrating a second example of an arrangement of a control system for a sheet feed unit.

FIG. 15 is a conceptual diagram illustrating a second example of an arrangement of a control system for a sheet feed unit 18. The control system for the sheet feed unit 18 is composed of a controller 100 included in the control unit 66, a load adjustment device (an actuator for load application) 88, objects 160 to be controlled, and a slide distance calculator 104.

In the second example of the arrangement of the control system for the sheet feed unit 18, substantially the same parts as those in the first example of the arrangement of the control system illustrated in FIG. 5 are assigned the same reference numbers. The objects 160 to be controlled include the feed member 24, the sensing part 84, the sheet sensor 91, and a sheet. According to control of the load adjustment device 88, the feed member 24 applies a certain load to a sheet. Hereupon, the encoder 82 encodes the amount of rotation of the sensing roller 80, thus detecting the position (X1) of the sheet, and the sheet sensor 91 detects the position (X2) of the sheet. These values X1 and X2 are output to the slide distance calculator 104. The slide distance calculator 104 included in the control unit 66 receives the values of X1 and X2, calculates the slide distance of the sheet (XS=X1−X2), and feeds the calculation result (observed distance) back to the controller 100.

Then, an image forming apparatus 210 according to a second exemplary embodiment of the invention is described based on the drawings.

Figure 16:
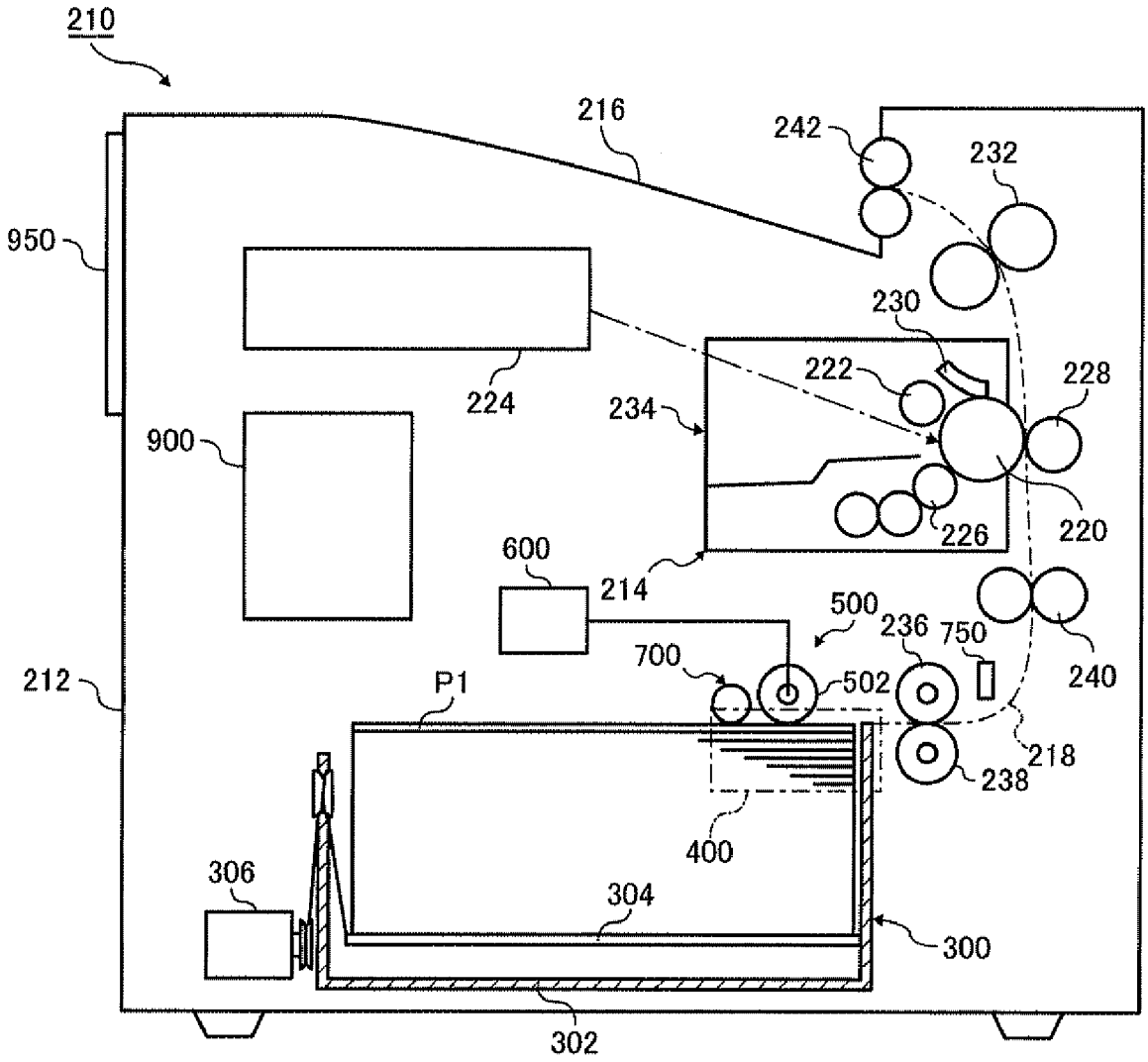
FIG. 16 is a right side view depicting an image forming apparatus according to a second exemplary embodiment of the invention.

FIG. 16 illustrates an outline of an image forming apparatus 210 according to a second exemplary embodiment of the invention.

The image forming apparatus 210 has an apparatus chassis 212 and an output tray 216 is provided on the top of the apparatus chassis 212. In the apparatus chassis 212, the following are installed: an image forming part 214; a stacker 300 in which sheets of sheet are stacked; a separator 400 that separates the sheets of sheet stacked in the stacker 300; a feed device 500 having a feed roll 502 which is used as a feed member that feeds a sheet of sheet separated by the separator 400 toward downstream in the transport direction; a pressing device 600 which is used as a pressing unit that presses the feed roll 502 against sheet; a transport condition sensing device 700 which is used as a transport condition sensing unit that senses the transport condition of sheet fed by the feed roll 502; and a control device 900 which is used as a unit for load control, air flow control, and setting.

In the apparatus chassis 212, a transport path 218 used for transporting sheet is formed. An operating panel 950 which is used as an operating unit is also mounted on the front surface of the apparatus chassis 212 (left side in FIG. 16).

The operating panel 950 has a numeric keypad or the like and is used to input the number of sheets, type, size, etc. of sheet on which an image is to be formed. Instead of inputting the number of sheets, type, size, etc. of sheet on which an image is to be formed via the operating panel 950, input from an operating device (not shown) such as, for example, a personal computer connected to the control device 900 is also possible.

The image forming part 14 is of an electrophotographic type and includes the following: a drum-shaped photoreceptor 220 used as an image carrying body; a charging device 222 that charges the photoreceptor 220 evenly; a exposure device 224 that, by light irradiation, exposes a latent image onto the photoreceptor 220 charged by the charging device 222; a development device 226 that develops with a developer a latent image formed on the surface of the photoreceptor 220 by the exposure device 224, thus making the latent image visible; a transfer device 228 that transfers a developer image made visible by the development device 226 onto sheet, wherein the transfer device 228 is formed of, for example, a transfer roller; a cleaning device 230 that clears remaining developer particles from the photoreceptor 220; and a fixing device 232 that fuses and fixates the developer image on sheet, transferred by the transfer device 228, to sheet. Among the members constituting the image forming part 214, the photoreceptor 220, charging device 222, development device 226, and cleaning device are integrated into an image forming structure 234. This structure can be installed into and removed from the apparatus chassis 212, for example, from the front side of the apparatus chassis 212.

The stacker 300 can be pulled out, for example, from the front side of the apparatus chassis 212 or can be installed into and removed from the apparatus chassis 212, for example, from the front side of the apparatus chassis 212. Additional sheet can be placed in the stacker 300 after it is pulled out or removed from the apparatus chassis 212.

The stacker 300 includes a stacker chassis 302, an elevating plate 304 that can move up and down with respect to the stacker chassis 302, and a motor 306 used as a driving source for moving the elevating plate 304 up and down with respect to the stacker chassis 302 stacker chassis 302. How much sheet remains in the stacker 300 is detected by a remaining sheet sensor which is omitted from the drawing stacker 300. By controlling the motor 306 according to the result of detection by the remaining sheet sensor, vertical moving of the elevating plate 304 is adjusted so that sheet P1 on the top of sheet stack on the elevating plate 304 is positioned at a constant level in height, regardless of how much sheet remains.

In the apparatus chassis 212, along the transport path 218, the above-mentioned feed device 500, a transport roller 236, a retard roller 238, registration rollers 240, the above-mentioned transfer device 228, the above-mentioned fixing device 232, and eject rollers 242 are arranged in a forward direction along the sheet transport direction. The transport roller 236 is used to transport sheet fed by the feed roll 502 downstream. The retard roller 238 is installed in abutting contact with the transport roller 236 and has a function to separate sheets of sheet fed from the feed roll 502 from one another. Thus, if two or more sheets of sheet, layered and not separated well by the separator 400, are fed, separating these sheets from one another will be done by the retard roller 238. The registration rollers 240 are used to guide sheet fed from the feed device 500 to pass a contact position between the photoreceptor 220 and the transfer device 228 in time with a phase of image forming operation of the image forming part 214. The eject rollers 242 are used to eject sheet on which a developer image has been fixated by the fixing device 232 to the output tray 216.

Downstream of the transport roller 236 and the retard roller 238 in the sheet transport direction, a sheet sensor 750 for sensing sheet is installed. A signal from the sheet sensor 750 is input to the control device 900.

In the image forming apparatus 210 configured as above, the photoreceptor 220 is evenly charged by the charging device 222 and a latent image is created on the charged photoreceptor 220 by light irradiation from the optical exposure device 224, based on an image signal. The development device 226 develops this latent image with a developer, thus producing a developer image. Meanwhile, sheet stacked in the stacker 300 is separated by the separator 400 and separated sheet is fed from by the feed device 500. The fed sheet is guided by the registration rollers 240 into between the transfer device 228 and the photoreceptor 220 in time with a phase of image forming operation of the image forming part 214 and a developer image is transferred to the guided sheet by the transfer device 228. The transferred developer image is fixated onto the sheet by th fixing device 232 and the sheet having the developer image fixed thereon is ejected by the eject roller 242 to the output tray 216.

Figure 17A:
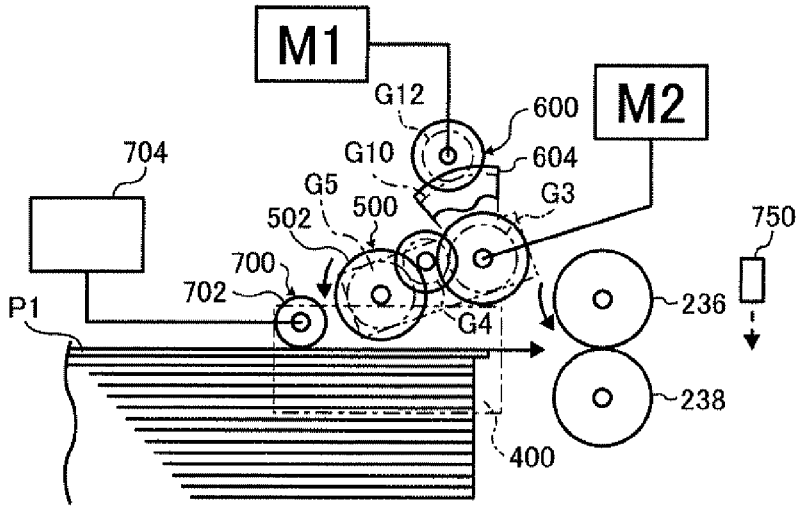
Figure 17B:
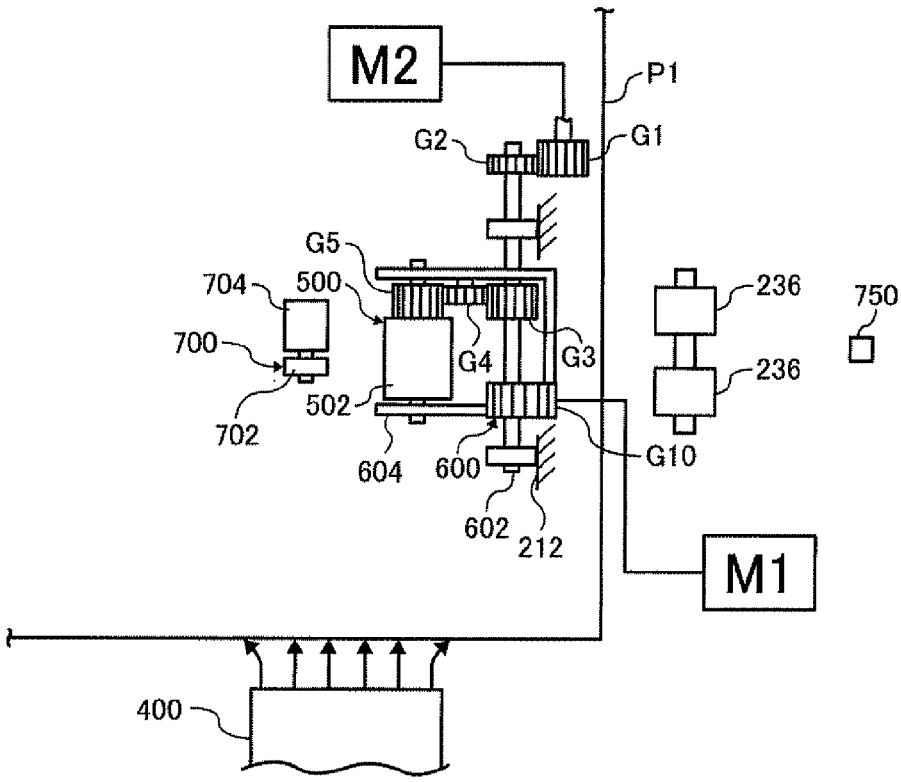

In FIGS. 17A and 17B, the separator 400, the feed device 500, the pressing device 600, and the transport condition sensing device 700 are depicted.

The separator 400, as depicted in FIG. 17A, is installed on the right side of the sheet stack, so that an air flow can be supplied to the sheet stack from the right side. The separator 400 will be detailed later.

The feed device 500 has a feed roll 502 which is used as a feed member that feeds sheet separated by the separator toward downstream in the transport direction, as described above. To the feed roll 502, a motor M2 used as a source for driving the feed roll 502 is coupled via gears G1, G2, G3, G4, and G5. The feed roll 502 can be displaced between a position where it contacts with sheet P1 on the top of the stack and a position where it is apart from sheet P1, as depicted in FIG. 17A. The motor M2 is connected to the control device 900 and controlled by the control device 900.

The pressing device 600 has a frame 604 rotatably supported on a shaft 602 which is secured to the apparatus chassis 212, a gear G12, and a motor M1.

The frame 604 is supported to allow the rotation of the above gears G3, G4, G5, and feed roll 502. The gears G3, G4, G5, and feed roll 502 together with the frame 604 are allowed to rotate and move with respect to the apparatus chassis 212. A protrusion is formed in part of, for example, the right side plate of the frame 604 and a gear G10 is formed in this protrusion.

To the gear G10, the motor M1 is coupled via a gear 12. Thus, the driving force of the motor M1 is conveyed via the gears G12 and G10 to the frame 604 and the frame 604 moves, rotating about the shaft 602. As the frame 604 moves, the feed roll 502 fixed to the frame 604 moves together. Thus, the feed roll 502 can be displaced between the position where it contacts with and presses sheet P1 and the position where it does not contact with sheet P1 and the pressing force (load) exerted on sheet P1 will change according to the position of the frame 604. The motor M1 is connected to the control device 900 and controlled by the control device 900.

The transport condition sensing device 700 includes a roller 702 which is used as a rolling member that contacts and rolls with sheet P1 and a first rotary encoder 704 which is used as a sheet moving measuring unit that measures the moving of sheet P1 from the amount of rotation of the roller 702. Output from the first rotary encoder 704 is input to the control device 900. The transport condition sensing device 700 will be detailed later.

Figure 18:
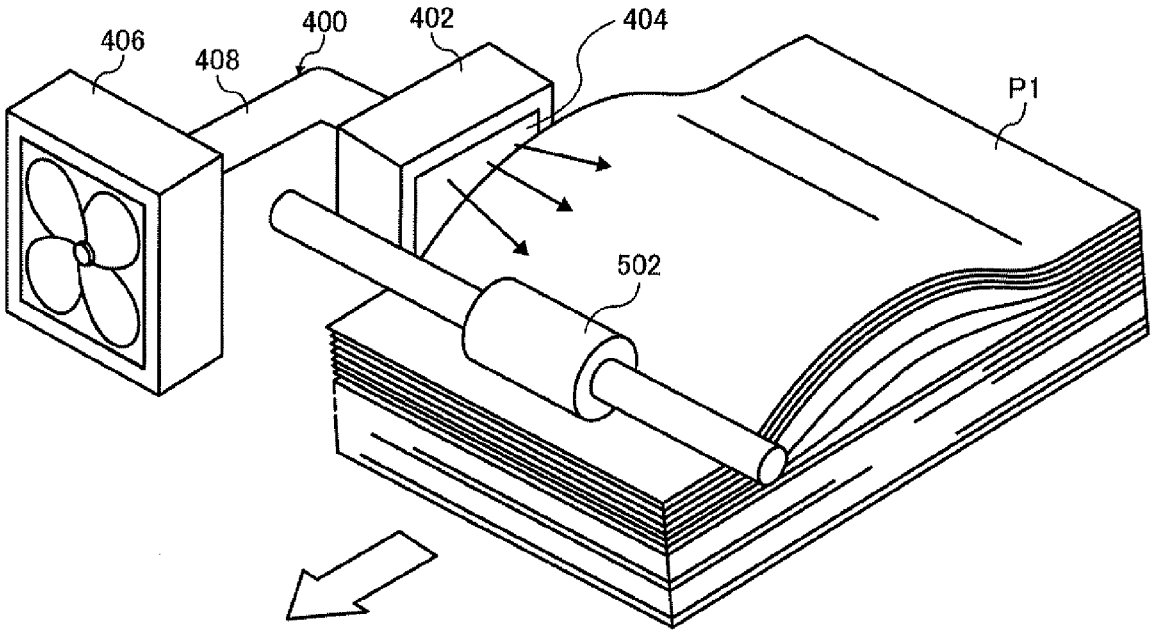
FIG. 18 is a perspective view depicting the separator included in the image forming apparatus according to the second exemplary embodiment of the invention.

In FIG. 18, the separator 400 is depicted.

The separator 400 includes a hollow box 402 in which an air outlet 404 used as a air flow blow opening is formed, an air blast fan 406 that generates an air flow to be supplied to the box 402, and a duct 408 connecting the box 402 and the air blast fan 406. The separator 400 sends an intake air from the air blast fan 406 via the duct 408 to the box 402 and blows an air flow from the air outlet 404 against sheet stacked in the stacker 300, thereby separating sheets of sheet stacked in the stacker 300.

The air blast fan 406 is connected to the control device 900 and, inter alia, the amount of air to blow against sheet per unit time is controlled by the control device 900.

Figure 19:
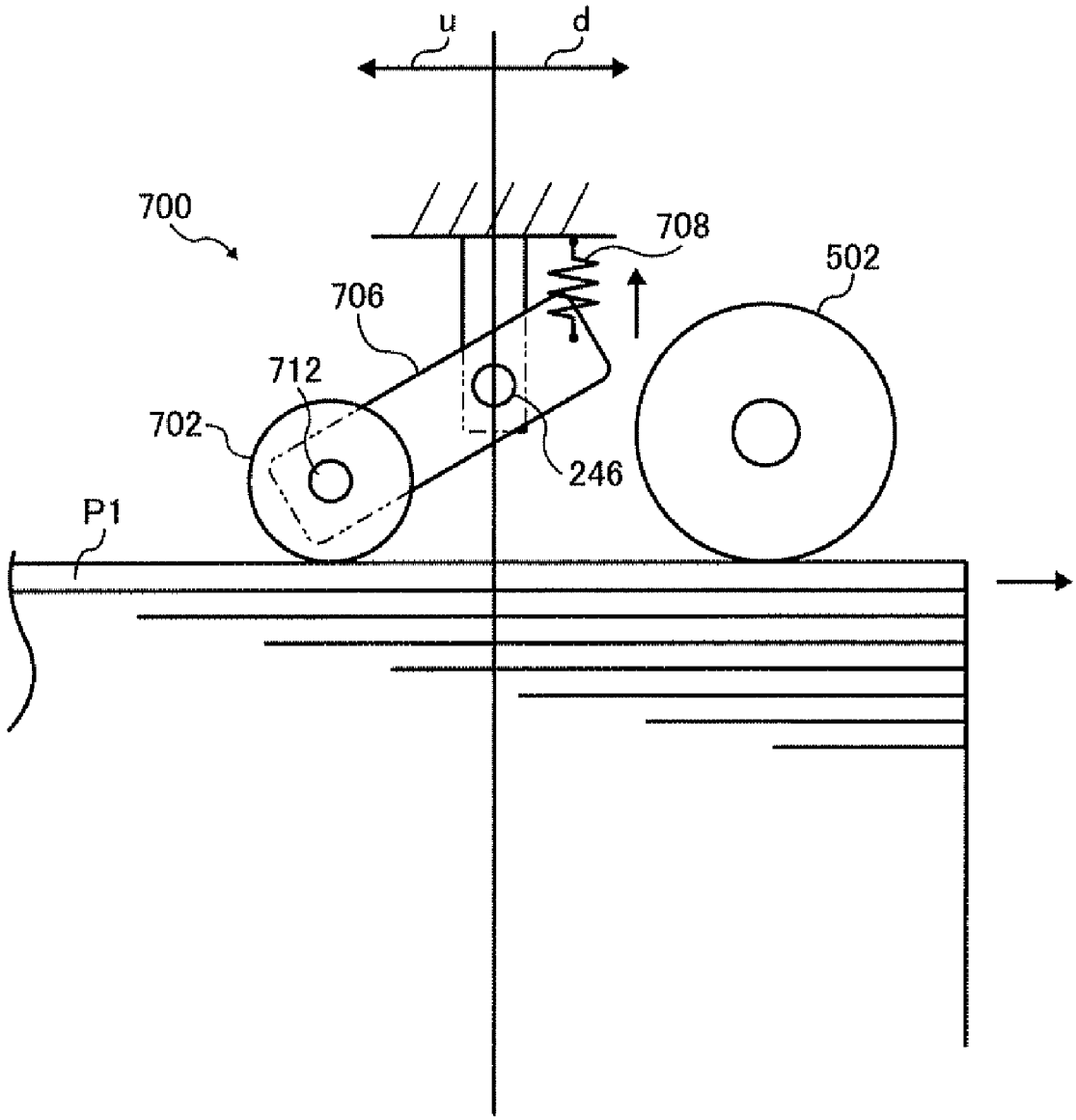
FIG. 19 is a right side view depicting the transport condition sensing device included in the image forming apparatus according to the second exemplary embodiment of the invention.

In FIG. 19, the transport condition sensing device 700 is depicted.

The transport condition sensing device 700 has the roller 702 and the first rotary encoder 704, as described above, and further includes a swaying member 706 and a pressing member 708 formed of an elastic body such as, for example, a coil spring.

The swaying member 706 can rotate about a support shaft 246 with respect to the apparatus chassis 212 and is supported on the support shaft 246 to allow swaying. Near one end of the swaying member 706, upstream in the sheet transport direction, the roller 702 is supported on a rotating shaft 712 to allow rotation. Near the other end of the swaying member 706, downstream in the sheet transport direction, one end of the pressing member 708 is fixed to the swaying member. The other end of the pressing member 708 is fixed to the apparatus chassis 212.

The rotating shaft 712 of the roller 702 is positioned in an upstream region u, not a downstream region d in the sheet transport direction, relative to the support shaft 246.

In the transport condition sensing device 700, the end of the swaying member 706, downstream in the sheet transport direction, is urged to be pulled up by the pressing member 708. By this urging force, the swaying member 706 rotates about the support shaft 246 to press the roller 702 against sheet P1. The urging force of the pressing member 708 is determined so that, when sheet P1 floats by air flow from the separator 400, it keeps the roller 702 in contact with sheet P1 and allows vertical moving of the roller 702 following the vertical moving of sheet P1.

Figure 20:
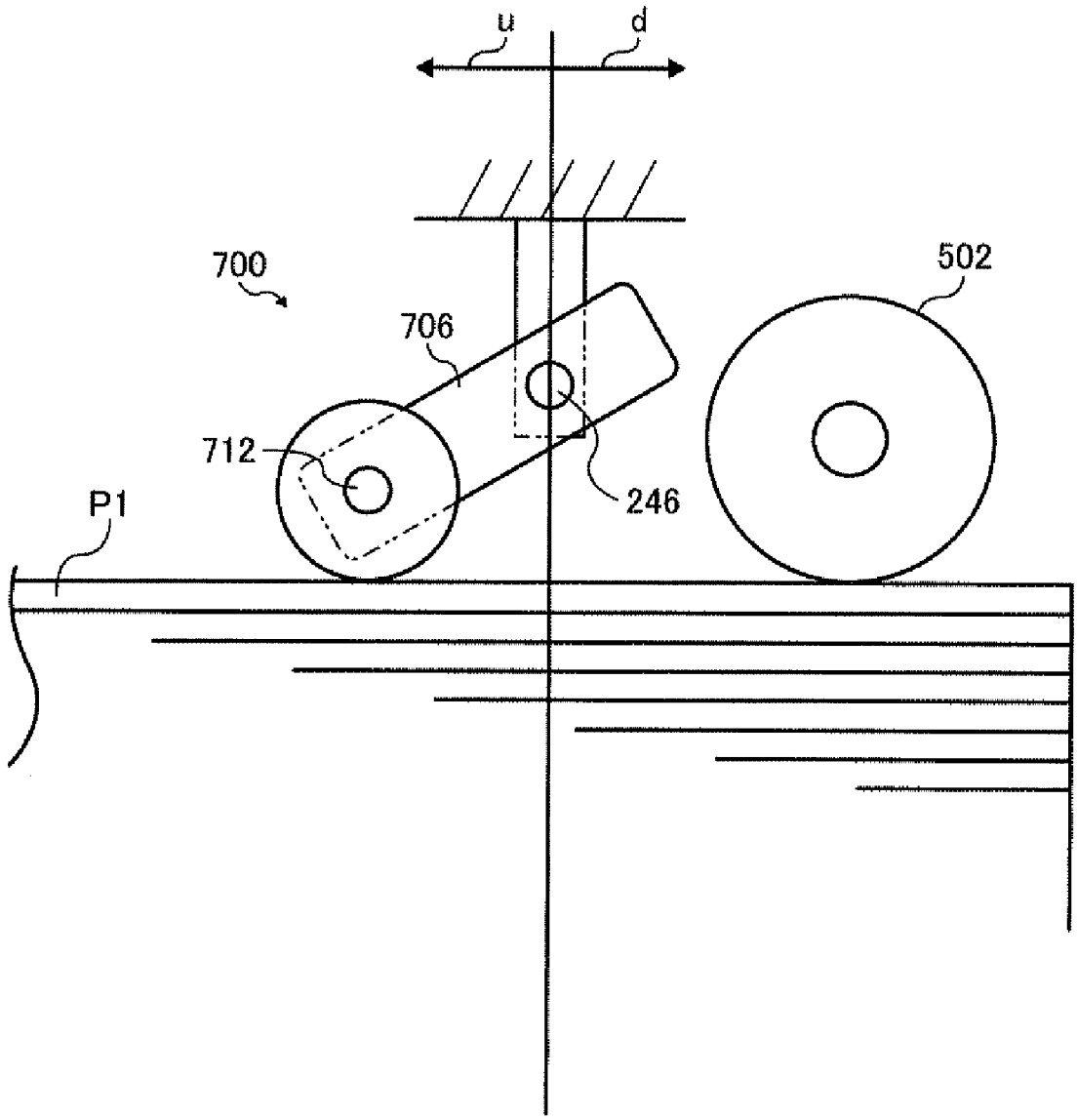
FIG. 20 is a right side view depicting a first modification example of the transport condition sensing device included in the image forming apparatus according to the second exemplary embodiment of the invention.

In FIG. 20, a first modification example of the transport condition sensing device 700 is depicted.

The transport condition sensing device 700 of the above-described exemplary embodiment has the pressing member 708 and the roller 702 is pressed against sheet P1 by the pressing member 708. However, the transport condition sensing device 700 of the first modification example does not have the pressing member 708 and the roller 702 is pressed against sheet P1 by gravity exerted on the roller 702, inter alia.

In the first modification example as well, the rotating shaft 712 of the roller 702 is positioned in the upstream region u, not the downstream region d in the sheet transport direction, relative to the support shaft 246. The parts corresponding to those in the transport condition sensing device 700 of the above-described exemplary embodiment are assigned the same numbers in FIG. 20 and their explanation is not repeated.

Figure 21A:
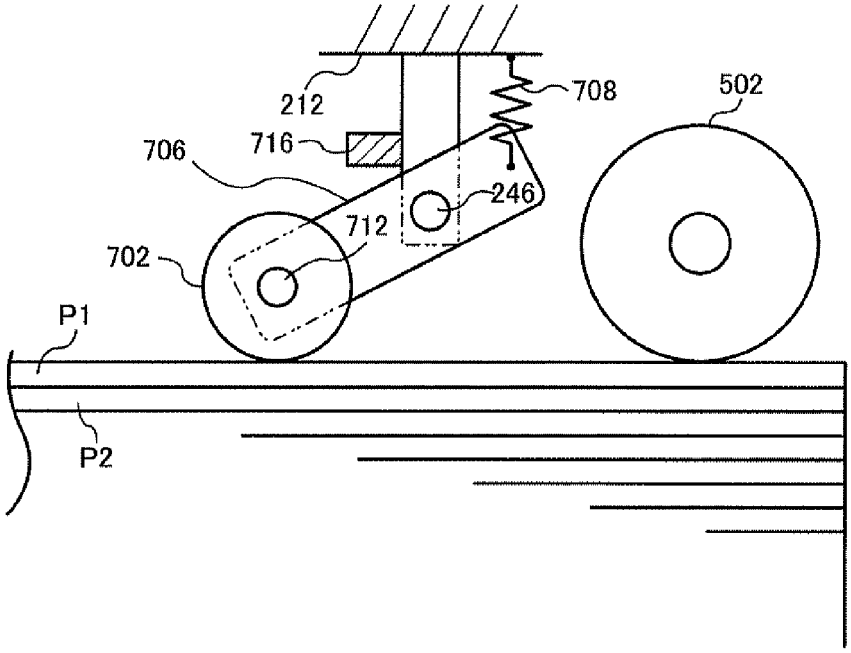

In FIG. 21, a second modification example of the transport condition sensing device 700 is depicted.

The transport condition sensing device 700 of the second modification example includes a restriction member 716 which is not included in the transport condition sensing device 700 of the above-described exemplary embodiment.

Figure 21B:
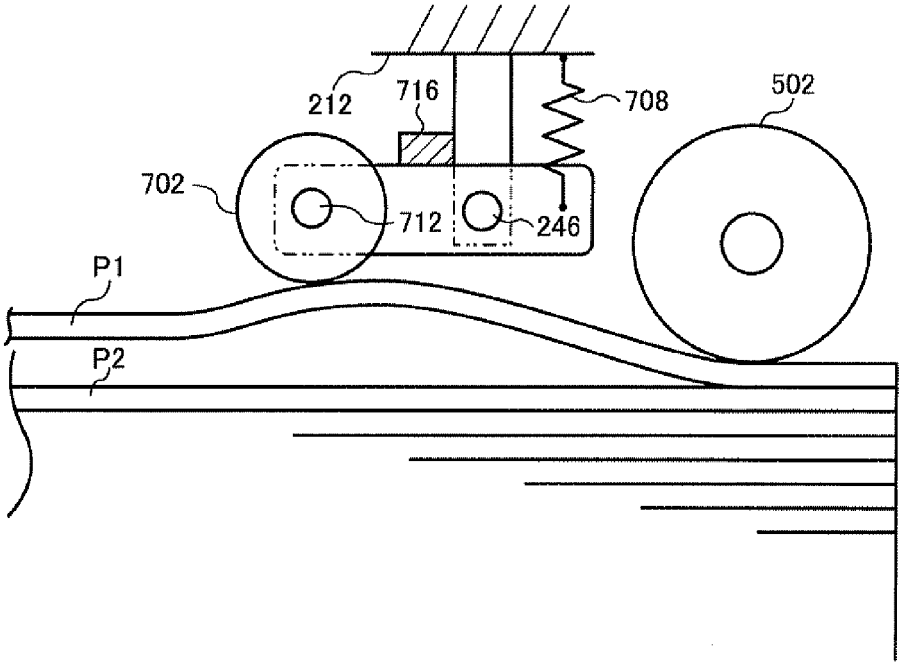

The restriction member 716 is installed in the vicinity of the support shaft 246 of the apparatus chassis 212 and has a function to restrict the swaying of the swaying member 706 to a certain range. That is, when sheet P1 floats by air flow supplied from the separator 400, as shown in FIG. 21B, the roller 702 also rises with the rise of sheet P1. Even if the swaying member 706 sways rotating clockwise in FIG. 21B, the swaying of the swaying member 706 is restricted when it hits against the restriction member 716. As the swaying of the swaying member 706 is restricted, the rise of the roller 702 is restricted. Consequently, as the rise of the roller 702 is restricted, the rise of sheet P1 is restricted. As above, in the transport condition sensing device 700 of the second modification example, the rise of sheet by air flow supplied from the separator 400 is restricted by the roller 702.

Figure 22:
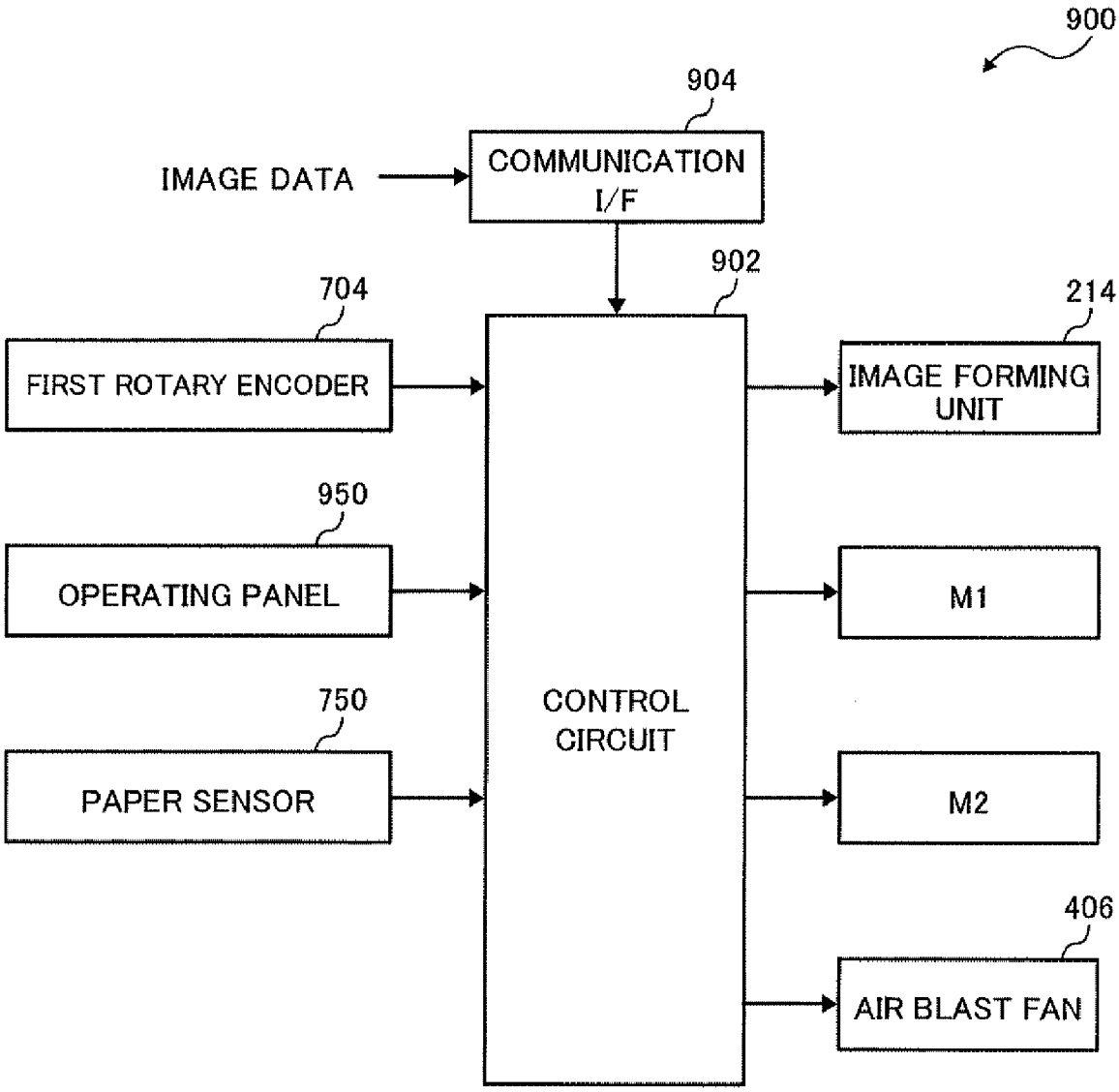
FIG. 22 is a block diagram depicting a control device included in the image forming apparatus according to the second exemplary embodiment of the invention.

In FIG. 22, the control device 900 is depicted.

The control device 900 includes a control circuit 902 which is formed of, for example, CPU. Image data is input to the control circuit 902 via a communication interface 904 and outputs from the first rotary encoder 704, from the operating panel 950, and from the sheet sensor 750 are input. According to output from the control circuit 902, the image forming part 214, motor M1, motor M2, and air blast fan 406 are controlled.

Figure 23:
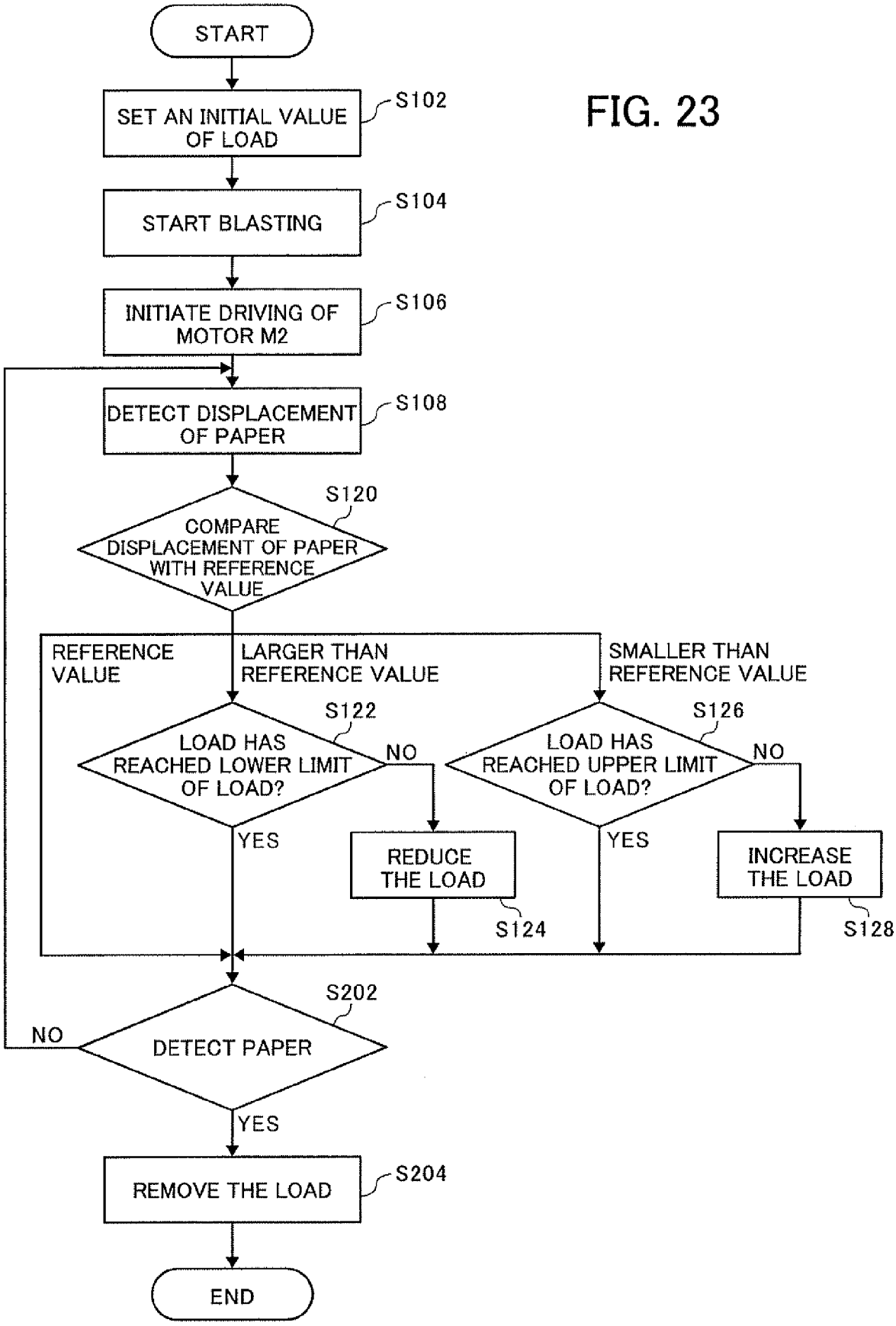
FIG. 23 is a flowchart illustrating control by the control device included in the image forming apparatus according to the second exemplary embodiment of the invention.

FIG. 23 illustrates a control flow by the control device 900.

As illustrated in FIG. 23, for example, when image data is input to the control circuit 902 via the communication interface 904, the control sequence starts. At step S102, according to either the speed or interval at which sheet is fed by the feed roll 502, the control device 900 sets an initial value of load by which the pressing device 600 presses the feed roll 502 against sheet. The control circuit drives the motor M1 so that the feed roll 502 is pressed against sheet P1 by the set load.

At step S104, the control device 900 starts the driving of the air blast fan 406 in the separator 400, which starts blowing of air flow against the sheet stack.

At next step S106, the control device 900 initiates the driving of the motor M2, which starts the rotation of the feed roll 502 and starts sheet feed.

At next step S103, the control device 900 instructs the first rotary encoder 704 to measure the moving of sheet.

At next step S120, the control device 900 compares the moving of sheet measured at step S108 with a predetermined reference value. If the moving of sheet measured at step S108 matches the predetermined reference value, the controller goes to step S202 without changing the load for pressing the feed roll 502 against sheet, i.e., keeping the load as is. If the moving of sheet measured at step S108 is larger than the predetermined reference value, the controller goes to step S122. If the moving of sheet measured at step S108 is smaller than the predetermined reference value, the controller goes to step S126.

At step S122, the controller determines whether the current load for pressing the feed roll 502 against sheet has reached a predetermined lower limit of load. If it has reached the lower limit, the controller goes to step S202 without changing the load for pressing the feed roll 502 against sheet, ice., keeping the load as is. Otherwise, if the current load for pressing the feed roll 502 against sheet does not reach the lower limit, the controller goes to step S124.

At step S124, the control device 900 drives the motor MI for the pressing device 600 and reduces the load for pressing the feed roll 502 against sheet. A reduction in the load for pressing the feed roll 502 against sheet reduces the possibility of damaging sheet. Because it has been determined at step S122 that the load does not reach the lower limit, even if the load is reduced, a trouble that sheet feed by the feed roll 502 becomes poor is not likely to occur.

At step S126, the controller determines whether the current load for pressing the feed roll 502 against sheet has reached a predetermined upper limit of load. If it has reached the upper limit, the controller goes to step S202 without changing the load for pressing the feed roll 502 against sheet, i.e., keeping the load as is otherwise, if the current load for pressing the feed roll 502 against sheet does not reach the upper limit, the controller goes to step S128.

At step S128, the control device 900 drives the motor M1 for the pressing device 600 and increases the load for pressing the feed roll 502 against sheet. An increase in the load for pressing the feed roll 502 against sheet increases the moving of sheet fed by the feed roll 502. Because it has been determined at step S126 that the load does not reach the upper limit, even if the load is increased, it is not likely to occur that sheet is damaged by the feed roll 502.

At step S202, it is determined whether the forward edge of sheet has been detected by the sheet sensor 750, and the controller returns to step S108 until it has been determined. When it has been determined at step S202 that the forward end of sheet has been detected, the controller goes to step S204.

At step S204, the control device 900 drives the motor M1 and causes the feed roll 502 to come off the sheet, thereby removing the load from the feed roll 502 against sheet.

While, in the above description, the control flow by the control device 900 for control of the load for pressing the feed roll 502 against sheet has been explained, the control device 900 also performs control of the air blast fan. That is, the control device 900 is also used as the control unit for controlling the air flow supplied from the separator 400. For example, according to either the type or size of sheet specified from the operating panel 950, the controller controls, for example, the amount of air flow to blow against sheet.

Figure 24A:
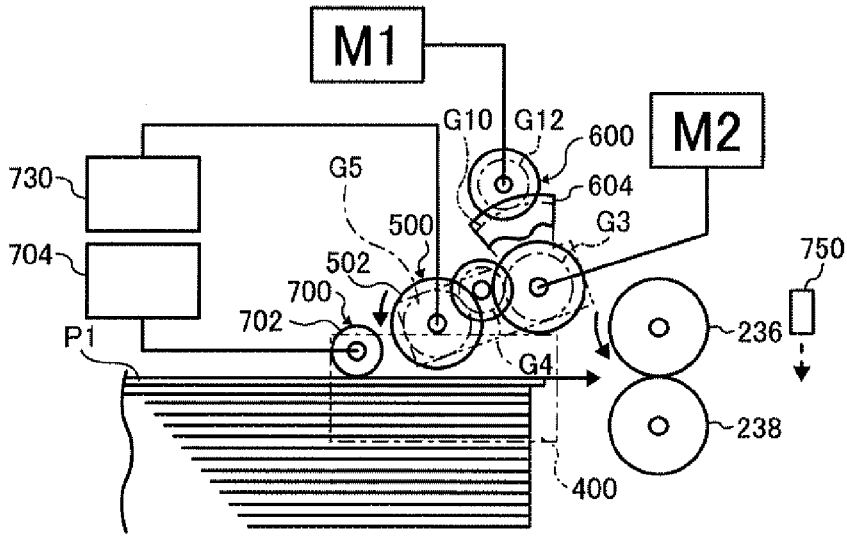
Figure 24B:
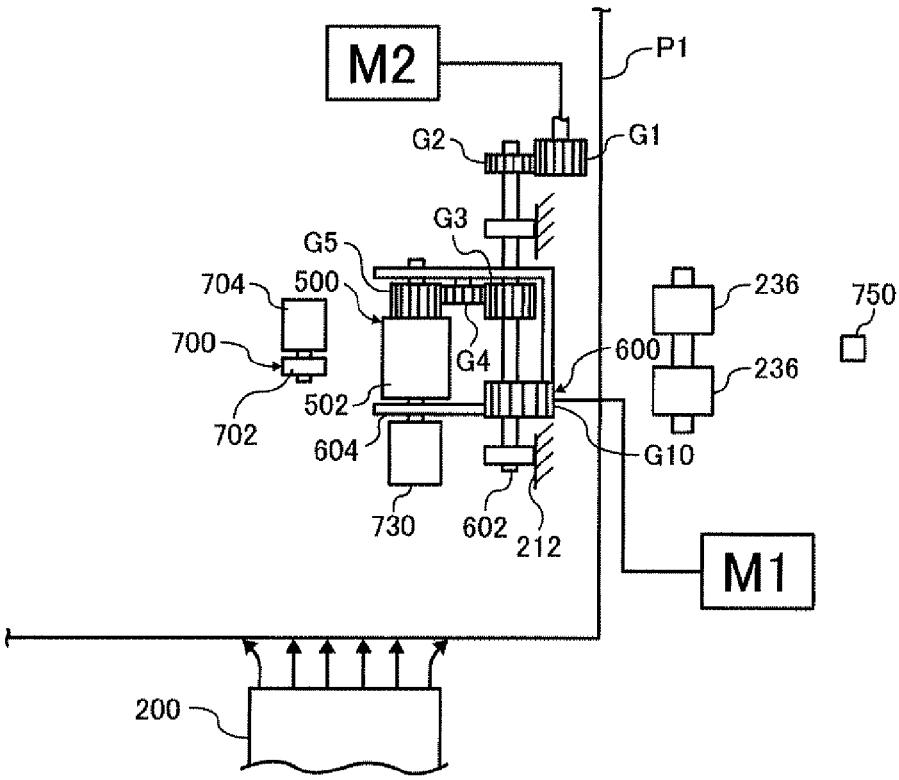

FIGS. 24A and 24B depict a transport condition sensing device 700 included in an image forming apparatus according to a third exemplary embodiment of the invention.

The transport condition sensing device 700 of the above second exemplary embodiment has the roller 702 and the first rotary encoder 704 connected to the roller 702 and used to measure the moving of sheet from the amount of rotation of the roller 702. Additionally, the transport condition sensing device 700 of the third exemplary embodiment of the invention includes a second rotary encoder 730 which is used as a contact surface moving measuring unit that measures the moving of the rolling surface 502*a*, which contacts with sheet P1, of the feed roll 502.

Figure 25:
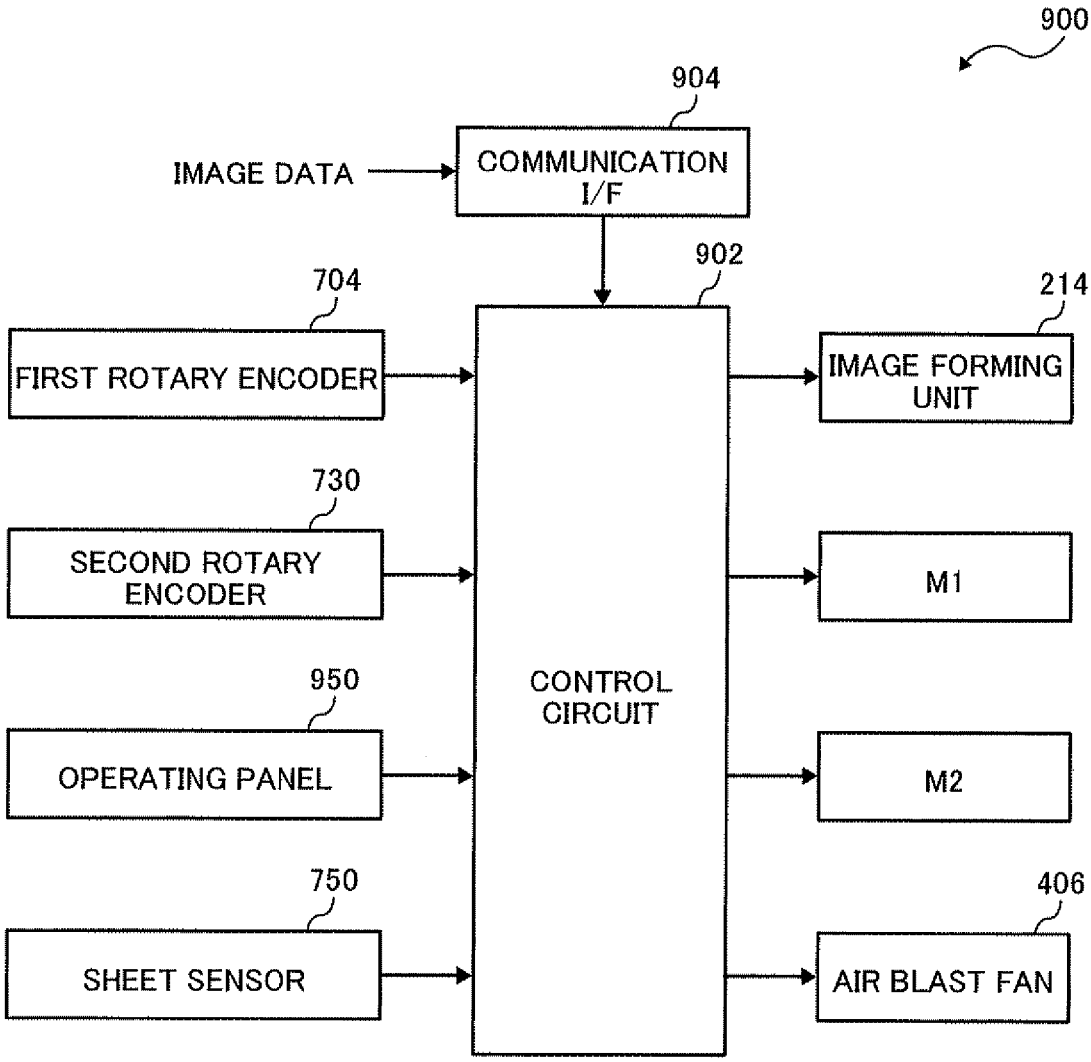
FIG. 25 is a block diagram depicting a control device included in the image forming apparatus according to the third exemplary embodiment of the invention.

FIG. 25 depicts a control device 900 included in the image forming apparatus according to the third exemplary embodiment of the invention.

In the control device 900 of the above second exemplary embodiment, the outputs from the first rotary encoder 704, from the operating panel 950, and from the sheet sensor 750 are input to the control circuit 902. In the control device 900 included in the image forming apparatus 210 according to the third exemplary embodiment, the output from second rotary encoder 730 is further input to the control circuit 902. As is the case for the control device 900 included in the image forming apparatus 210 according to the second exemplary embodiment, the image forming part 214, motor M1, motor M2, and air blast fan 406 are controlled by the output from the control circuit 902.

Figure 26:
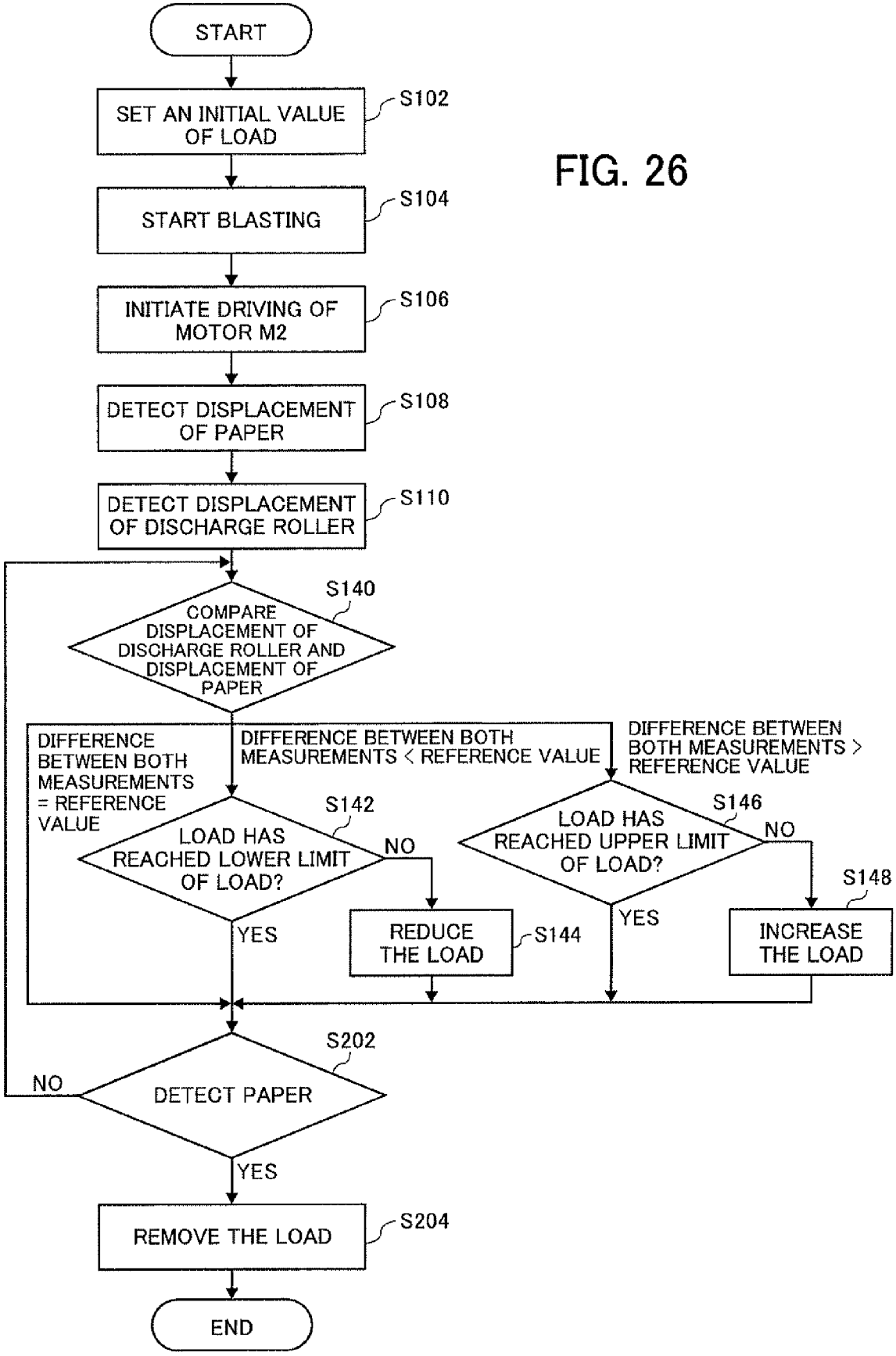
FIG. 26 is a flowchart illustrating control by the control device included in the image forming apparatus according to the third exemplary embodiment of the invention.

FIG. 26 illustrates a control flow by the control device 900 included in the image forming apparatus 210 according to the third exemplary embodiment of the invention.

In the above second exemplary embodiment, at step S108, the control device 900 instructs the first rotary encoder 704 to measure the moving of sheet. At the following step S120, the controller compares the moving of sheet measured at step S108 with a predetermined reference value. Depending on the result of the comparison, the load for pressing the feed roll 502 against sheet is controlled.

In the third exemplary embodiment, after the control device 900 instructs the first rotary encoder 704 to measure the moving of sheet at step S108, it instructs the second rotary encoder 730 to measure the moving of the rolling surface 502*a* of the feed roll 502 at step S110. At a subsequent step S140, the controller compares the measured moving of sheet and the measured moving of the rolling surface 502*a*. Depending on the result of the comparison, the controller controls the load for pressing the feed roll 502 against sheet.

More specifically, at step S140, the control device 900 compares the moving of sheet measured at step S108 and the moving of the rolling surface 502*a* measured at step S110. If a difference between both measurements is equivalent to a certain reference value, the controller goes to step S202 without changing the load for pressing the feed roll 502 against sheet, i.e., keeping the load as is. If the difference between both measurements is smaller than the reference value, the controller goes to step S142. If the difference between both measurements is larger than the reference value, the controller goes to step S146.

At step S142, the controller determines whether the current load for pressing the feed roll 502 against sheet has reached a predetermined lower limit of load. If the load has reached the lower limit, the controller goes to step S202 without changing the load for pressing the feed roll 502 against sheet, i.e., keeping the load as is otherwise, if the current load for pressing the feed roll 502 against sheet does not reach the lower limit, the controller goes to step S144.

At step S144, the control device 900 drives the motor M1 for the pressing device 600 and reduces the load for pressing the feed roll 502 against sheet. A reduction in the load for pressing the feed roll 502 against sheet reduces the possibility of damaging sheet. Because it has been determined at step S142 that the load does not reach the lower limit, even if the load is reduced, a trouble that sheet feed by the feed roll 502 becomes poor, for example, due to a slip occurring between the feed roll 502 and sheet, is not likely to occur.

At step S146, the controller determines whether the current load for pressing the feed roll 502 against sheet has reached a predetermined upper limit of load. If the load has reached the upper limit, the controller goes to step S202 without changing the load for pressing the feed roll 502 against sheet, i.e., keeping the load as is. Otherwise, if the current load for pressing the feed roll 502 against sheet does not reach the upper limit, the controller goes to step S148.

At step S148, the control device 900 drives the motor M1 for the pressing device 600 and increases the load for pressing the feed roll 502 against sheet. An increase in the load for pressing the feed roll 502 against sheet reduces the possibility of slippage between the feed roll 502 and sheet and increase the moving of sheet fed by the feed roll 502. Because it has been determined at step S146 that the load does not reach the upper limit, even if the load is increased, it is not likely to occur that sheet is damaged by the feed roll 502.

Control steps other than the steps explained above are the same as for the above first exemplary embodiment and assigned the same numbers (step numbers) in FIG. 26 and their explanation is not repeated.

Figure 27A:
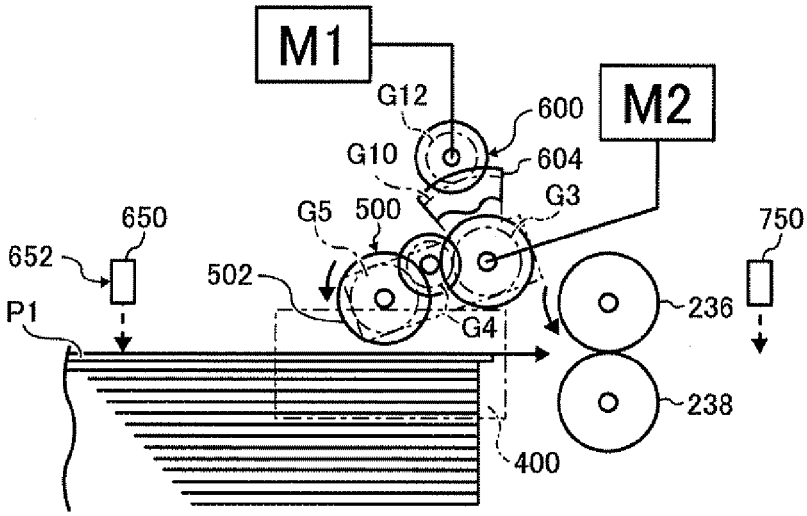
Figure 27B:
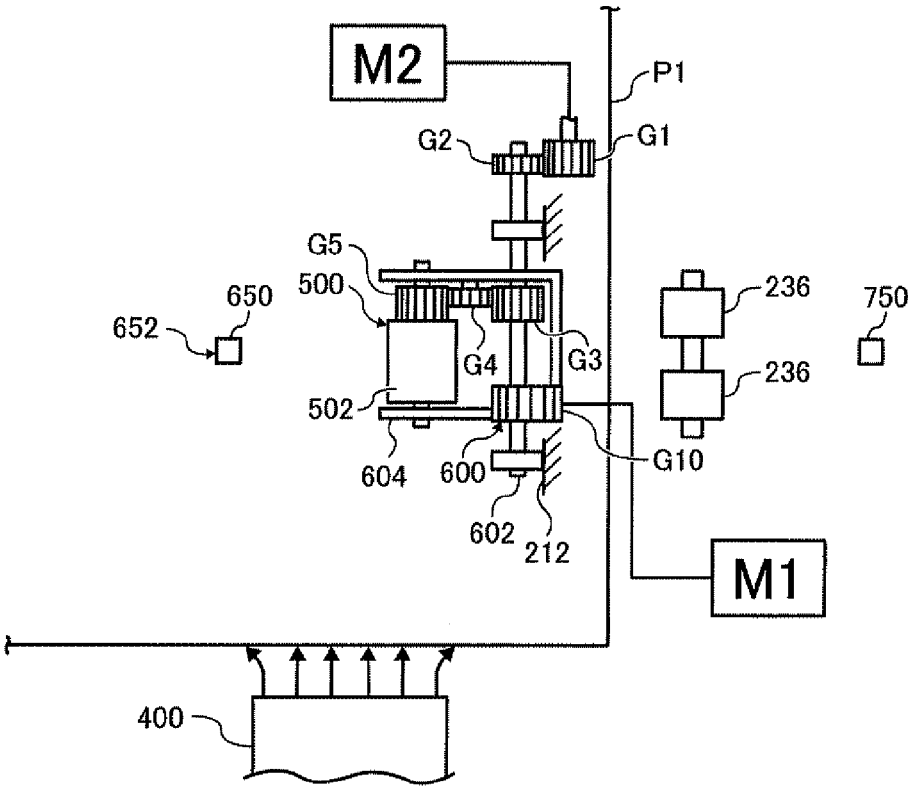

FIGS. 27A and 27B illustrate a feed device 500, a pressing device 600, and periphery thereof in an image forming apparatus 210 according to a fourth exemplary embodiment of the invention.

The image forming apparatus 210 according to the above second exemplary embodiment and the image forming apparatus 210 according to the above third exemplary embodiment include the transport condition sensing device 700 for sensing the transport condition of sheet. Alternatively, the image forming apparatus 210 according to the fourth exemplary embodiment includes a float condition sensing device 650 instead of the transport condition sensing device 700.

The float condition sensing device 650 is used as a float condition sensing unit that senses the float condition of sheet floated by an air flow supplied from the separator 400 and has a laser moving meter 652. The laser moving meter 652 is positioned above sheet P1 on the top of sheet stack in the stacker 300 and detects the height of sheet P1 floating from the top of the sheet stack. The parts corresponding to those in the first exemplary embodiment are assigned the same numbers in FIG. 27 and their explanation is not repeated.

Figure 28:
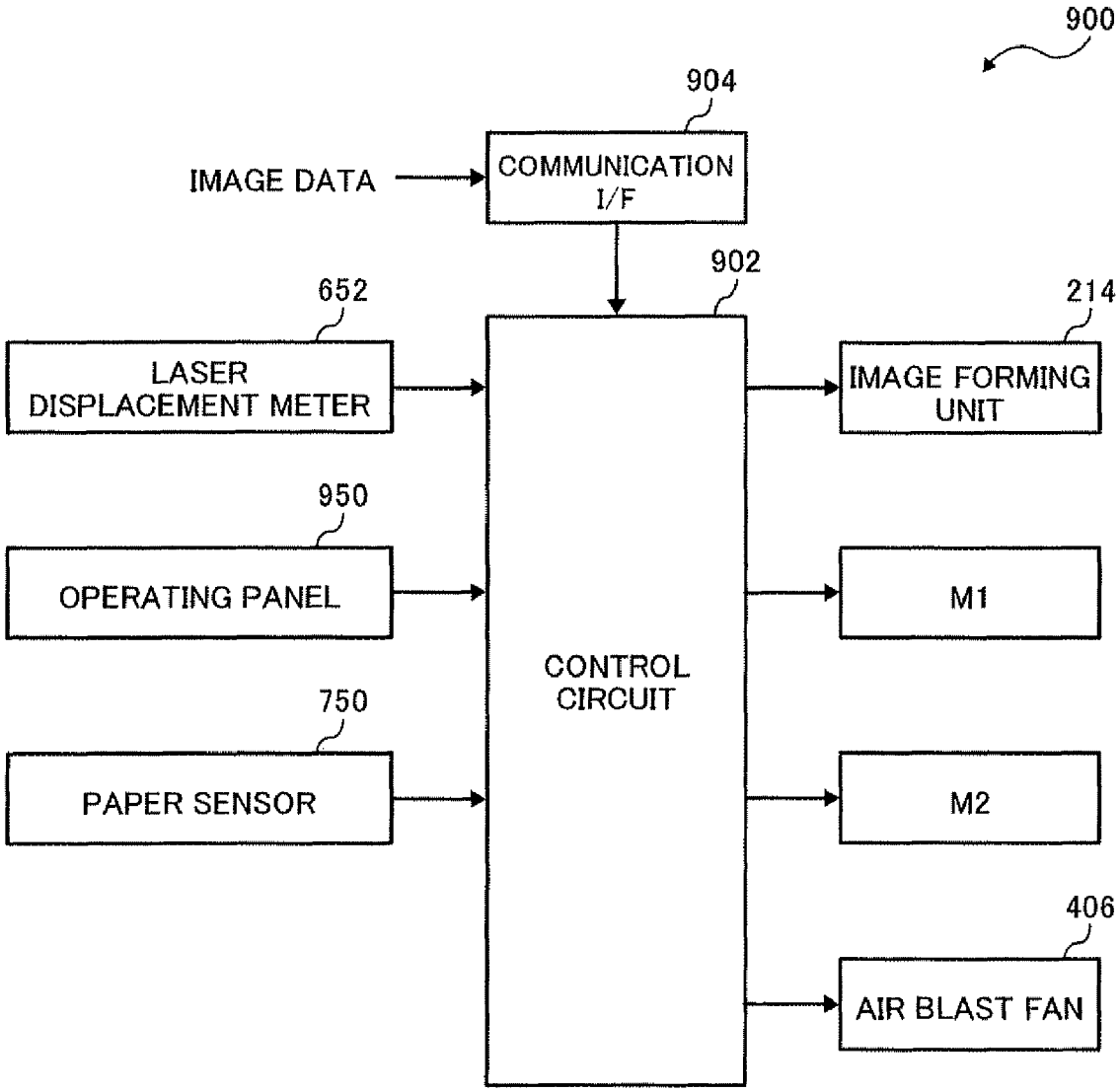
FIG. 28 is a block diagram depicting a control device included in the image forming apparatus according to the fourth exemplary embodiment of the invention.

FIG. 28 depicts a control device 900 included in the image forming apparatus 210 according to the fourth exemplary embodiment of the invention. In the above second exemplary embodiment, the outputs from the first rotary encoder 704, from the operating panel 950, and from the sheet sensor 750 are input to the control circuit 902. In the fourth exemplary embodiment, the output from the laser moving meter 652 instead of the output from the first rotary encoder 704 is input to the control circuit 902. As is the case for the second exemplary embodiment, the outputs from the operating panel 950 and from the sheet sensor 750 are input to the control circuit 902 and the image forming part 214, motor M1, motor M2, and air blast fan 406 are controlled by the output from the control circuit 902.

Figure 29:
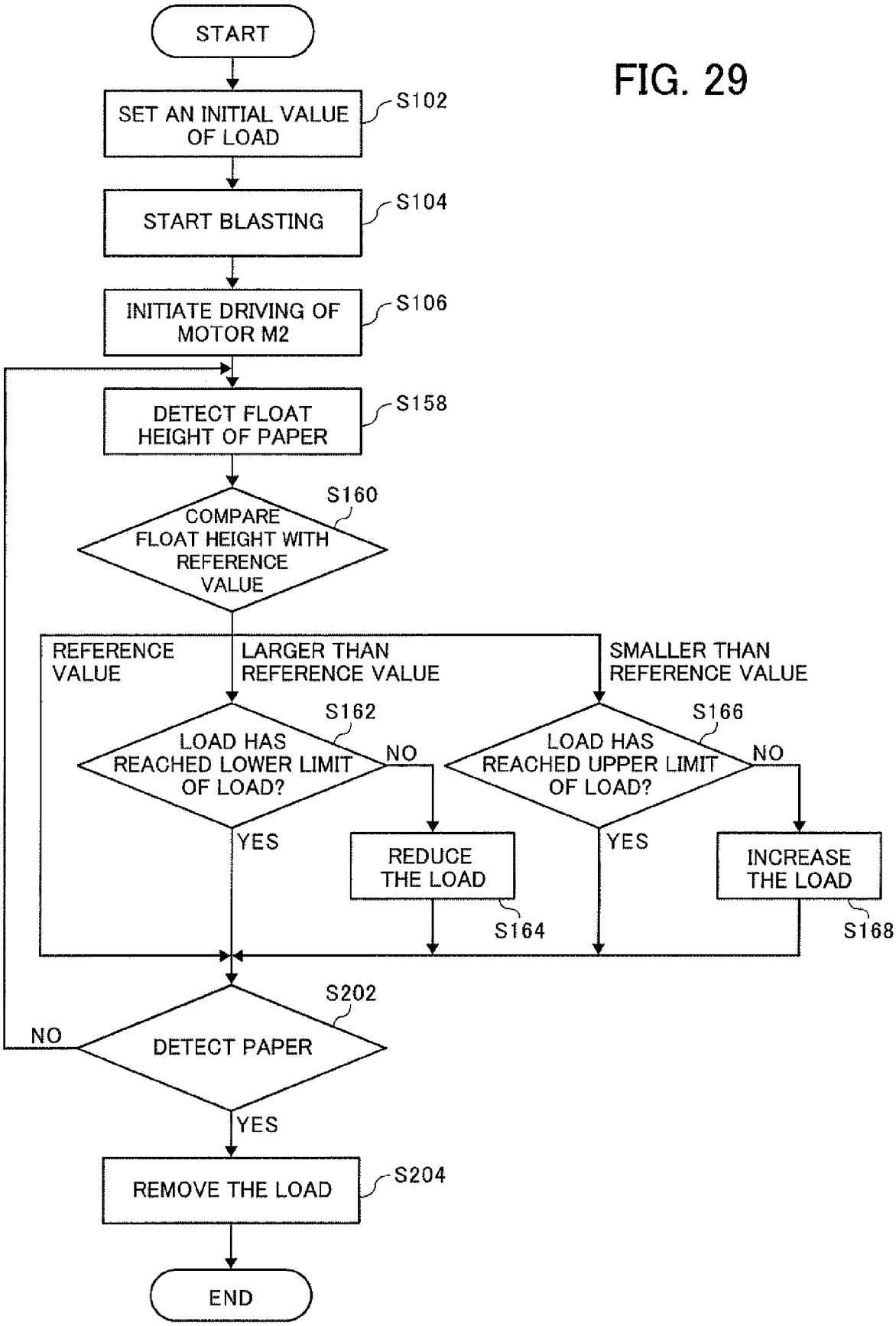
FIG. 29 is a flowchart illustrating control by the control device included in the image forming apparatus according to the fourth exemplary embodiment of the invention.

FIG. 29 illustrates a control flow by the control device 900 included in the image forming apparatus 210 according to the fourth exemplary embodiment of the invention.

In the above second exemplary embodiment, at step S108, the control device 900 instructs the first rotary encoder 704 to measure the moving of sheet. At the following step S120, the controller compares the moving of sheet measured at step S108 with a predetermined reference value. Depending on the result of the comparison, the load for pressing the feed roll 502 against sheet is controlled.

In the fourth exemplary embodiment, at step S159, the control device 900 instructs the laser moving meter 652 to detect the float condition (height or float height) of sheet. In a subsequent step S160, the controller compares the float height measured at step S160 with a predetermined float height. Depending on the result of the comparison, the controller controls the load for pressing the feed roll 502 against sheet.

More specifically, at step S160, the control device 900 compares the float height measured at step S158 with a predetermined reference value. If there is no difference between the measured float height and the reference value, the controller goes to step S202 without changing the load for pressing the feed roll 502 against sheet, i.e., keeping the load as is. If the measured float height is larger than the reference value, the controller goes to step S162. If the measured float height is smaller than the reference value, the controller goes to step S166.

At step S162, the controller determines whether the current load for pressing the feed roll 502 against sheet has reached a predetermined lower limit of load. If the load has reached the lower limit, the controller goes to step S202 without changing the load for pressing the feed roll 502 against sheet, i.e., keeping the load as is. Otherwise, if the current load for pressing the feed roll 502 against sheet does not reach the lower limit, the controller goes to step S164.

At step S164, the control device 900 drives the motor M1 for the pressing device 600 and reduces the load for pressing the feed roll 502 against sheet. A reduction in the load for pressing the feed roll 502 against sheet reduces the possibility of damaging sheet. Because it has been determined at step S162 that the load does not reach the lower limit and sheet floats higher than the reference value, good separation of the top sheet of sheet P1 is expected, even if the load is reduced, a trouble that sheet feed by the feed roll 502 becomes poor is not likely to occur.

At step S166, the controller determines whether the current load for pressing the feed roll 502 against sheet has reached a predetermined upper limit of load. If the load has reached the upper limit, the controller goes to step S202 without changing the load for pressing the feed roll 502 against sheet, i.e., keeping the load as is. Otherwise, if the current load for pressing the feed roll 502 against sheet does not reach the upper limit, the controller goes to step S168.

At step S168, the control device 900 drives the motor M1 for the pressing device 600 and increases the load for pressing the feed roll 502 against sheet. An increase in the load for pressing the feed roll 502 against sheet facilitates good feed of sheet, even if the float height of sheet is less than the reference value and separation of the top sheet of sheet P1 is not sufficient. Because it has been determined at step S166 that the load does not reach the upper limit, even if the load is increased, it is not likely to occur that sheet is damaged by the feed roll 502.

Control steps other than the steps explained above are the same as for the above first exemplary embodiment and assigned the same numbers (step numbers) in FIG. 29 and their explanation is not repeated.

Figure 30:
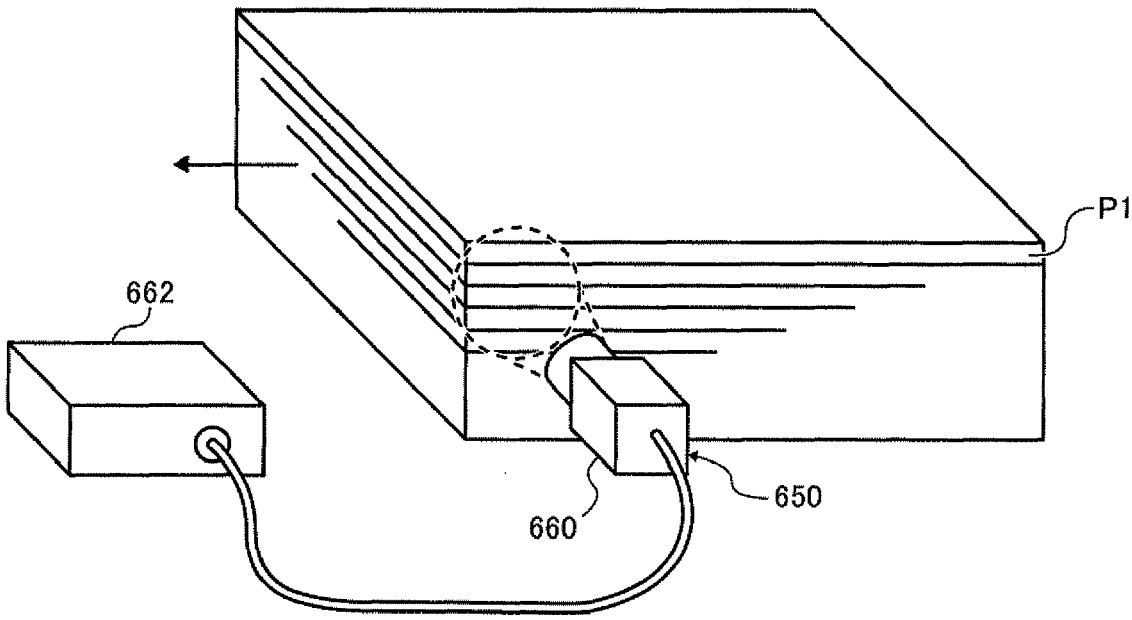
FIG. 30 is a perspective view depicting a modification example of the float condition sensing device included in the image forming apparatus according to the fourth exemplary embodiment of the invention.

FIG. 30 depicts a modification example of the float condition sensing device 650.

The float condition sensing device 650 of this modification example includes a camera 660 which is used as an image capturing device that captures an image of the sheet stack from a direction including a component vertical to the stack direction of sheet. The camera 660 is connected via an image data processing device 662 to the control device 900 and output from the camera 660 is input to the control device 900 via the image data processing device 662. According to the float condition sensing device 650 of this modification example, it is possible to detect the float condition of not only the top sheet of sheet P1, but also other sheets in the sheet stack.

As explained hereinbefore, the present invention can be applied to image forming apparatus such as duplicating machines, facsimile equipment, copies, etc. as well as a sheet feed device or sheet feed device used in such image forming apparatus and the like.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A sheet feed device comprising:

an air flow generating part that generates an air flow for floating a sheet;

a feed member that feeds a sheet by rotating, while applying a load to the top one of sheets stacked;

a transport condition sensing unit that is positioned not to obstruct an air flow generated by the air flow generating part and senses a transport condition of a sheet fed by the feed member, the transport condition including, at least, displacement of the sheet fed by the feed member; and a load adjustment unit that adjusts the load applied to a sheet by the feed part, based on a result of sensing of the transport condition sensing unit.

2. The sheet feed device according to claim 1, wherein the air flow generating part generates an air flow at least in a direction crossing a sheet feed direction.

3. The sheet feed device according to claim 1, wherein the air flow generating part generates an air flow at least in an opposite direction to the sheet feed direction.

4. The sheet feed device according to claim 1, wherein the transport condition sensing unit includes a rolling member that contacts and rolls with a sheet being transported and a sheet moving measuring part that measures the moving of a sheet from an amount of rotation of the rolling member.

5. The sheet feed device according to claim 1, wherein the transport condition sensing unit is positioned within a region where an air flow generated by the air flow generating part is blocked by the feed member.

6. The sheet feed device according to claim 1, further comprising a load applicator that applies a load to the top one of the sheets stacked in an upstream position in the sheet feed direction, wherein the transport condition sensing unit is attached to the load applicator.

7. The sheet feed device according to claim 1, further comprising an air flow adjustment unit that adjusts an air flow generated by the air flow generating part, based on a result of sensing of the transport condition sensing unit.

8. The sheet feed device according to claim 7, further comprising a support member to which the feed member and the transport condition sensing unit are attached, wherein the transport condition sensing unit is displaced as the support member is displaced.

9. The sheet feed device according to claim 1, further comprising a rotation amount sensing part that senses an amount of rotation of the feed member and a calculator that calculates sliding of a sheet, based on a result of sensing of the rotation amount sensing part and a result of sensing of the transport condition sensing unit, wherein the load adjustment unit adjusts the load applied to a sheet by the feed member, based on a result of calculation of the calculator.

10. The sheet feed device according to claim 9, wherein the transport condition sensing unit is displaced in conjunction with a moving of the feed member occurring when the load adjustment unit adjusts the load applied to a sheet by the feed member.

11. The sheet feed device according to claim 1, wherein the transport condition sensing unit senses information about the moving of a sheet without contacting with the sheet.

12. The sheet feed device according to claim 1, wherein the transport condition sensing unit includes:

a rolling member that contacts and rolls with a sheet being transported;

a sheet moving measuring part that measures the moving of sheet from the amount of rotation of the rolling member; and a contact surface moving measuring part that measures the moving of a contact surface, which contacts with sheet, of the feed member, and the control unit controls a pressing force exerted on the feed member by the pressing unit, based on a difference between the moving of the contact surface measured by the contact surface moving measuring part and the moving of sheet measured by the sheet moving measuring part.

13. The sheet feed device according to claim 12, wherein the rolling member is vertically displaced following sheet floated by an air flow supplied from the separator.

14. The sheet feed device according to claim 13, further comprising a swaying member that supports the rolling member rotatably and is swayably supported on a support shaft, wherein a rotating shaft of the rolling member is positioned upstream of the support shaft in a sheet transport direction.

15. An image forming apparatus comprising:

an image forming part that forms an image on a sheet;

a sheet feed device that feeds a sheet to the image forming part; and an air flow generating part that generates an air flow for floating a sheet to be fed by the sheet feed device, the sheet feed device including:

a feed member that feeds a sheet by rotating, while applying a load to the top one of sheets stacked, a transport condition sensing unit that senses the transport condition of a sheet fed by the feed member, the transport condition including, at least, displacement of the sheet fed by the feed member, and the transport condition sensing unit being positioned not to obstruct an air flow generated by the air flow generating part; and a load adjustment unit that adjusts the load applied to a sheet by the feed part, based on a result of sensing of the transport condition sensing unit.

16. The image forming apparatus according to claim 15, further comprising an apparatus chassis that houses the image forming part, wherein the air flow generating part is removably installed in the apparatus chassis.

17. An image forming apparatus comprising:

an image forming part that forms an image on a sheet; and a sheet feed device that feeds a sheet to the image forming part, the sheet feed device including:

a feed member that feeds a sheet by rotating, while applying a load to the top one of sheets stacked, a transport condition sensing unit that senses a transport condition of a sheet fed by the feed member, the transport condition including, at least, displacement of the sheet fed by the feed member, and the transport condition sensing unit being positioned not to obstruct an air flow for floating a sheet; and a load adjustment unit that adjusts the load applied to a sheet by the feed part, based on a result of sensing of the transport condition sensing unit.

* * * * *